US010827567B2

(12) United States Patent
Eadan et al.

(10) Patent No.: US 10,827,567 B2
(45) Date of Patent: Nov. 3, 2020

(54) AUTONOMOUS CAVITY RESONATOR AND HEAT MAP

(71) Applicants: Milo Eadan, Arcata, CA (US); Francis Eugene Toriello, Syracuse, NY (US)

(72) Inventors: Milo Eadan, Arcata, CA (US); Francis Eugene Toriello, Syracuse, NY (US)

(73) Assignees: Milo Eadan, Arcata, CA (US); Francis Eugene Toriello, Syracuse, NY (US)

( * ) Notice: Subject to any disclaimer, the term of this patent is extended or adjusted under 35 U.S.C. 154(b) by 517 days.

(21) Appl. No.: 15/785,956

(22) Filed: Oct. 17, 2017

(65) Prior Publication Data

US 2019/0116634 A1 Apr. 18, 2019

(51) Int. Cl.
*H05B 6/64* (2006.01)

(52) U.S. Cl.
CPC ..... *H05B 6/6447* (2013.01); *H05B 6/6402* (2013.01); *H05B 6/6411* (2013.01); *H05B 6/6482* (2013.01); *H05B 6/6494* (2013.01); *H05B 6/6444* (2013.01)

(58) Field of Classification Search
CPC .. H05B 6/6447; H05B 6/6402; H05B 6/6411; H05B 6/6482; H05B 6/6494; H05B 6/6444; H05B 6/688; H05B 6/664; H05B 6/6467; H05B 6/72; A47J 37/0623; A47J 36/02; A47J 37/0664
USPC ..... 219/678, 680, 681, 702, 703, 709, 714, 219/728, 731, 734, 710, 745, 746, 748, 219/750, 754, 762; 99/325, 333
See application file for complete search history.

(56) References Cited

U.S. PATENT DOCUMENTS 6,448,540 B1 * 9/2002 Braunisch ..... H05B 6/6494 219/685

OTHER PUBLICATIONS

Vollmer, Michael, "Physics of the microwave oven," Physics Education 39 (1), IOP Publishing (2004).
"Advanced Electromagnetism. Part 5: Cavities and Waveguides," University of Liverpool. (2013).
"Waveguides and Resonators," ch. 23, pp. 432-456.
Dai, Jianming et al. "Visualization of Microwave Energy Distribution in a Multimode Microwave Cavity using CoCl2 on Gypsum Plates," Journal of Microwave Power and Electromagnetic Energy, 44 (3), pp. 144-152 (2010).
Thuery, Jacques, "Microwaves: Industrial, Scientific and Medical Applications," Artech House, ch. 2, pp. 33-82 (1992).

* cited by examiner

*Primary Examiner* — Phuong T Nguyen
(74) *Attorney, Agent, or Firm* — Milo Eadan

(57) ABSTRACT

An automated microwave oven configured to autonomously determine a duration of time for heating an object based on a location of the object in a microwave cavity. The heating duration may be a function of cumulative energy estimated to be experienced by the object due to the object location, e.g., radial distance from center, under rotational motion of the rotating tray. A concentric energy visualization is provided on an interior surface of the microwave cavity, representing a function of cumulative energy experienced under rotational motion of a rotating tray about its center-line. The visualization may comprise a plurality of rings concentric about the center-line, each concentric ring representing a constant value of the function of cumulative energy, oscillating in value along the radial length of the rotating tray.

6 Claims, 16 Drawing Sheets
(16 of 16 Drawing Sheet(s) Filed in Color)

AUTONOMOUS CAVITY RESONATOR AND HEAT MAP

FIELD OF THE INVENTION

Embodiments of the invention relate to the field of cavity resonators, and in particular, to microwave ovens.

BACKGROUND OF THE INVENTION

Cavity resonators, such as microwave ovens, emit waves in an enclosed three-dimensional (3D) space that interfere to form standing waveforms. The waveforms have stationary regions of minimal oscillation referred to as "nodes" in which the waves cancel by destructive interference as well as regions of maximal oscillation referred to as "anti-nodes" in which the waves amplify by constructive interference oscillating between peaks and troughs. At nodes, stagnant waves transfer minimal energy to particles forming "cold-spots," while at anti-nodes, amplified waves excite particles by maximal energy forming "hot-spots." These nodes and anti-nodes are arranged in a 3D pattern that provides non-uniform energy and heat distribution throughout the cavity resonator. FIG. 1 shows a thermal pattern across a 2D horizontal cross-section of a microwave. The thermal pattern has an array of cold-spots and hot-spots formed by a corresponding array of respective nodes and anti-nodes throughout the microwave.

Such non-uniform heat distribution causes microwaves to undercook in some regions (at nodes) and overcooked in other regions (at anti-nodes). This irregular heating degrades the taste of food and may even be hazardous to health, e.g., due to bacteria in under-heated food or carcinogens in over-heated food.

To solve this problem, microwave ovens typically use a revolving tray to rotate food in concentric circles across microwave nodes and anti-nodes to more evenly distribute microwave energy. However, even under rotation, highly non-uniform heat patterns remain. For example, the cold-spot formed at the center of the microwave cross-section in FIG. 1 is not eliminated under concentric rotation by the microwave tray. Some microwave designs include additional motors to glide the microwave tray laterally from side-to-side, to translate as well as rotate food. Other designs add a stirring mechanism to distribute heat in liquid samples. However, the machinery necessary to implement these manual corrections is generally too complicated and too expensive for practical use.

Accordingly, microwave design has remained essentially the same since its inception in the 1950s. There is therefore a longstanding need inherent in the art to provide a cost-effective solution to the problem of uneven heating in microwave ovens.

SUMMARY OF THE INVENTION

In some embodiments of the invention, the aforementioned longstanding problem inherent in the art is overcome by automating microwave ovens to autonomously determine a duration of time for heating an object, e.g., that cancels or compensates for uneven heating due to hot or cold spots based on the object's location. In one embodiment, the microwave may autonomously increase the duration of time for heating an object positioned (e.g., centered) at a cold spot and decrease the duration of time for heating an object positioned (e.g., centered) at a hot spot.

In some embodiments of the invention, an automated microwave oven is configured, using one or more processors, to autonomously determine a duration of time for heating an object, e.g., based on a location of the object in a microwave cavity. A location of the object in a cavity of the microwave oven may be determined. A duration of time may be determined for heating an object as a function of a cumulative energy estimated to be experienced by the object due to the determined location of the object. The duration of time for heating the object may be determined by shifting a target heating duration of time by an offset duration of time to cancel a relative increase or decrease in the function of the cumulative energy experienced by the object due to the determined object location. A microwave source, under the control of the one or more processors, may emit microwaves to heat the object for the determined duration of time.

In some embodiments of the invention, the aforementioned longstanding problem inherent in the art is overcome by imprinting a visualization of a heat or energy map showing a pattern of nodes and anti-nodes on an interior cavity of a microwave oven, for example, to guide a user to an optimal placement of an object to cancel or compensate for uneven heating due to hot or cold spots at the object's location. The heat map may image a function of energy aggregated or integrated under angular rotation in concentric circles due to the motion of the revolving tray. An example visualization is shown in FIG. 16.

In some embodiments of the invention, a concentric heat or energy visualization is imprinted on an interior surface of a cavity of a microwave oven. The visualization may represent a function of cumulative energy experienced under rotational motion of a rotating tray about a center-line of the rotating tray that is orthogonal to the top surface of the rotating tray at its center-point. The visualization may include a plurality of rings concentric about the center-line in the plane of the top surface of the rotating tray. Each concentric ring may visualize a constant value of the function of cumulative energy, and different rings may visualize a plurality of different values of the function of cumulative energy that oscillate along a line from the radial center to the radial edge of the rotating tray.

In some embodiments, the autonomous timer and heat map may be combined to provide additional advantages when operated in tandem. In one example, a user may choose to place an object on a hot-spot (or cold-spot) visualized by the heat map, and the autonomous timer may reduce (or increase) the heating time according to that object's location to avoid over-heating (or under-heating) the object. In another example, the visualization may define distinct zones for different heating times and a user may indirectly cause the automated microwave to heat for the desired time by placing the object in a corresponding zone.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

Specific embodiments of the present invention will be described with reference to the following drawings, wherein.

The particular waveforms and energy or heat distributions illustrated in FIGS. 1-16 are representations based on example microwave dimensions; waveforms or heat distributions will differ for microwaves with different dimensions. The methods and equations below apply generally to any microwave dimensions.

DETAILED DESCRIPTION OF THE INVENTION

Figure 16:
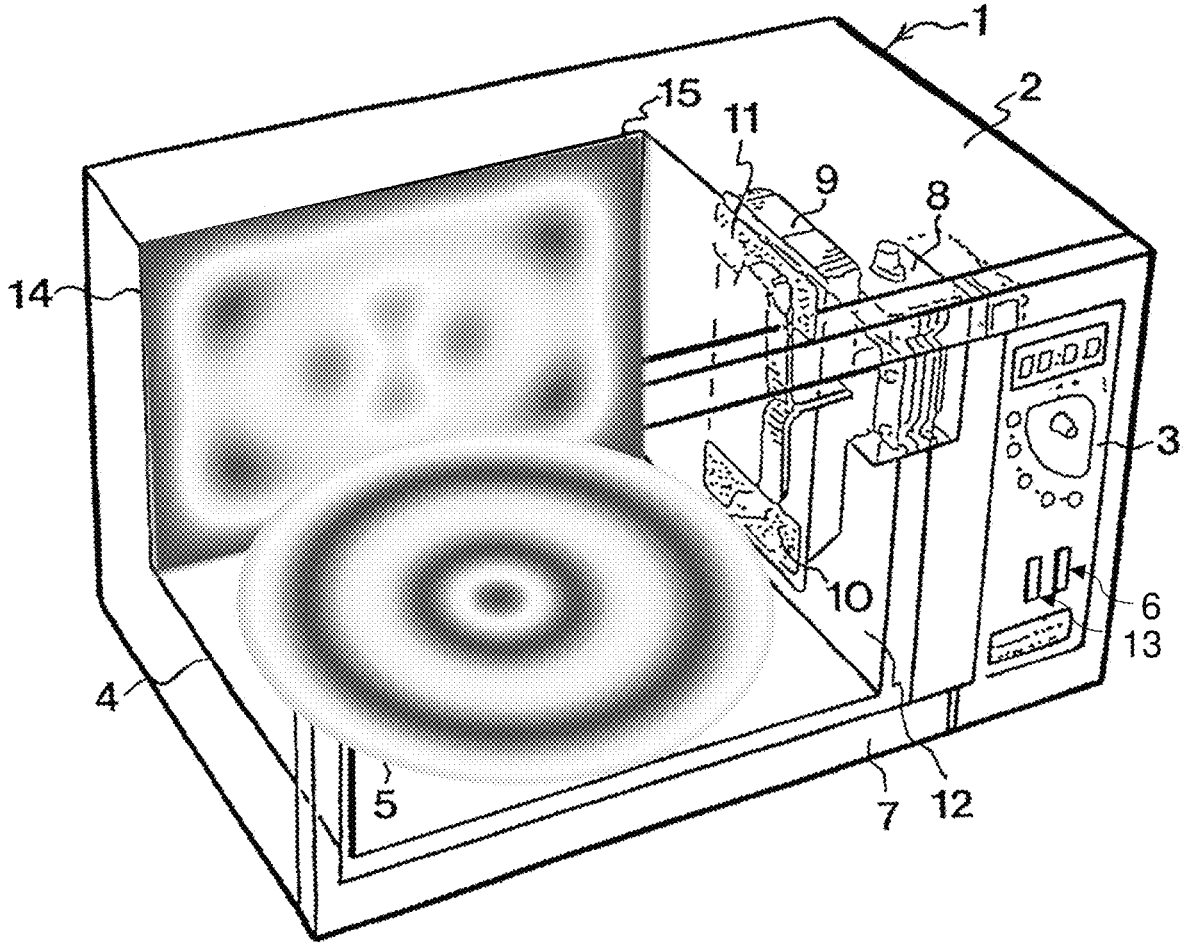
FIG. 16 is a schematic illustration of an example microwave, in accordance with some embodiments of the invention.

"Microwave" may refer to either the electro-magnetic wave or to a cavity resonator emitting those waves, i.e., a microwave oven (e.g., shown in FIG. 16). Electro-magnetic microwaves typically have wavelengths that range between approximately one millimeter and one meter (e.g., 12.5 cm or 5 inches) and frequencies that range between approximately 300 megahertz (MHz) and 300 gigahertz (GHz) (e.g., 2.45 GHz). Embodiments of the invention, though described in reference to microwaves, apply generally to all other electro-magnetic waves, e.g., having either a single frequency or multiple frequency emission spectrum, including but not limited to, radio waves, Infrared (IR) waves, ultraviolet (UV) waves, and X-rays.

A microwave oven is a "cavity resonator"—a 3D space enclosed by conductive walls—which emits and resonates waves in the microwave frequency spectrum. Microwave ovens are typically tuned to a frequency of, for example, approximately 2.45 GHz (wavelength of approximately 12.5 cm or 5 inches). Since the walls of the microwave are conductive, according to Gauss' law, the electric field integrated around a closed surface surrounding the microwave cavity must be zero. Microwaves emitted within this closed conductive surface can therefore not cross the cavity walls and are thus reflected off the walls and back into the cavity of the microwave. This reflection causes standing waves to form in the microwave at the specific resonant frequenc(ies) to which the microwave is tuned, e.g., 2.45 GHz. These standing waves form the aforementioned 3D pattern of nodes (cold-spots) and anti-nodes (hot-spots). The positions of these nodes and anti-nodes depend on the dimensions of the microwave cavity. The resulting heat or energy distribution may resemble a lattice or array of symmetric anti-nodes representing heat pockets in the 3D space of the microwave cavity.

The heat distribution experienced by an object inside a microwave becomes averaged when the object is revolved in a circle by the microwave tray. Under rotation, the heat distribution is radially symmetric, since an object placed at any radius from the tray's center point will rotate along approximately the same circular path and be heated for approximately the same amount of time (assuming the tray revolves an integer number of complete revolutions). Accordingly, for any height and an integer number of revolutions the calculated heat distribution depends only the radial distance of the object from the center point of the tray, and not on the specific position or angle of the object along that radius. The heat distribution may be represented on the top surface of the rotating tray by a 2D cross-section with a plurality of concentric circles or rings since the heat distribution is radially symmetric when the tray rotates a complete number of revolutions. Each circle of the heat distribution may be concentric about the tray's center point in the 2D cross-section, or concentric about a vertical center line of the tray in the 3D microwave cavity (e.g., the z-axis in FIG. 16). Each circle on the rotating tray may define an independent constant heat value at a different radius. The heat values may oscillate along a line from the radial center to the radial edge of the tray, increasing near hot-spots and decreasing near cold-spots. The heat values may oscillate continuously (e.g., smoothly) or discretely (e.g., in a stair-step function) depending on the resolution or thickness of the rings. While some heat values may cyclically repeat along the radial line, a plurality of those constant heat values (e.g., each pair of neighboring ring's values) are different.

In an embodiment of the invention, the heat distribution may be computed as a function of cumulative energy or heat that an object is estimated to experience under rotational motion of a rotating tray about a vertical or z-axis center-line that is orthogonal to the horizontal surface of the rotating tray at its center-point. The function may be computed by determining the energy or heat distribution experienced by a stationary object, for example, as the energy density $U_i$ of the multiple resonant modes i of the microwave oven $$\left(\text{e.g., } U_i = \frac{\varepsilon_0}{2}(E_x^2 + E_y^2 + E_z^2),\right.$$

where Ex, Ey, Ez, are the energy functions of the microwave in the x, y, and z dimensions, respectively), rotating that energy density $U_i$ of each mode under the rotational motion of a rotating tray, for example, by converting the energy density into polar coordinates and integrating about the vertical center-line of the rotating tray by a complete revolution of $2\pi$ radii (e.g., $\int_0^{2\pi} U_i d\theta$), and aggregating the rotated energy density of all the modes i of the microwave oven (e.g., $\Sigma_i \int_0^{2\pi} U_i d\theta$). Each position of the function is aggregated or integrated along concentric circles, resulting in a cumulative energy or heat distribution along horizontal planes that vary based only on radial distance from the vertical center-line (1D), but not based on position or angle along that radial distance (2D). The result is a heat map of concentric rings of varying degrees of heat or energy centered about the vertical center-line (see e.g., FIG. 14).

Once the cumulative energy or heat distribution of the microwave oven is known, in some embodiments on the invention, the microwave oven may autonomously set or adjust an object's heating time based on the object's position in the microwave to compensate for discrepancies in the cumulative energy or heat distribution experienced based on the object's position. For example, the microwave oven may set a relatively high or increased heating time when an object is positioned on a cold spot and set a relatively low or decreased heating time when an object is positioned on a hot spot. The object's position (e.g., radial distance between the object's center point and the center line intersecting the rotating tray) may be detected automatically (e.g., by one or more sensors or contacts on or under the tray or one or more cameras imaging the object from an opposing interior surface, such as the microwave ceiling) or obtained via manual user-input (e.g., selecting a position or zone via controls, such as control panel 3 of FIG. 16). In one embodiment, the rotating tray may include or be connected to a detector at its base that detects the torque and/or weight of the object placed in the microwave. The object's weight may be measured when the object is centered on the tray (e.g., to cancel torque, such as, during an initialization measurement), obtained by a user-entered weight or based on user-entered properties, estimated based on image data of the object, and/or assumed to be an average weight. A torque measurement, together with the weight, may be used by the microwave to estimate the object's radial distance. The microwave may determine the duration of time based on other object parameters in addition to or instead of its position, such as, the object's weight, density, size, temperature, type, or state, such as, solid or liquid, etc.

In some embodiments, the microwave may determine the heating time fully-autonomously or partially-autonomously. In a full-autonomous setting, the microwave may use a heat model to autonomously select a time associated with the object's position and/or other parameters. In this way, a user merely places an object in the microwave, closes the door, and, without selecting any amount of time or providing any other input, the microwave automatically determines the heating time and heats the object for that time. The microwave may store a correspondence table or function converting a set or vector of parameter values (e.g., of weight, position, density, temperature, state of food, etc.) to a heating time. These parameter values may be autonomously determined by imagers and/or detectors in the microwave. Weight may be autonomously determined by the microwave, e.g., via a scale coupled to the base of the rotating tray. Position may be autonomously determined by the microwave, e.g., via one or more imagers in the microwave cavity or a torque scale coupled to the base of the rotating tray. Density may be autonomously determined by the microwave, e.g., via the combination of the weight scale and imagers, or the torque scale alone. Temperature may be autonomously determined by the microwave, e.g., via one or more temperature sensors such as thermometers, thermal-sensitive contacts, or infrared imagers within the microwave cavity or on the rotating tray. The state of the object (e.g., liquid or solid) may be autonomously determined by the microwave, e.g., via one or more imagers in the microwave cavity, such as detecting a liquid when the top surface of the object is horizontal, when the contents of a container conform to its edge, when the imaged volume and measured weight indicate a density approximating that of water; and otherwise detecting a solid.

In a partially-autonomous setting, the microwave may receive an initial or target time entered by a user and may adjust the initial time up or down by an increment proportional to the difference of the energy function at the detected position from a threshold or average of the energy function. For example, if the object is placed in a relatively cold-spot or hot-spot, the microwave may increase or decrease the user-entered time, respectively. The increment may be fixed or may be proportional to the difference from the threshold or average of the energy function at the detected position, such that, the object may be heated with approximately the same energy or energy density, regardless of its position. In this way, a user selects an intended or target time (or pre-set times, e.g., "popcorn"), and the microwave automatically adjusts the actual heating time based on the relative disparity of the heat experienced at the object's location relative to a threshold, to mimic the target heating time were the object located at an average heating spot. In some embodiments, setting or adjusting the time of heating based on the object position may even the heating experienced by an object placed at different locations throughout the microwave to provide more uniform heating for objects in different positions.

Additionally or alternatively, in some embodiments of the invention, a visualization is provided of a heat or energy distribution of electro-magnetic microwaves at a plurality of points in a microwave oven imprinted on a surface thereof, such as, on a surface of a rotating tray or along any other interior surface of the microwave cavity.

A heat or energy "visualization," "map," "waveform," or "distribution" may refer to a 2D or 3D function of energy, energy density, heat, heat flux, temperature, work, power, or any derivation thereof, which may be scaled, averaged, aggregated, integrated, projected, normalized, or otherwise manipulated or transformed over space and/or time. A 2D heat map may be imprinted or otherwise visualized on a surface of a microwave. A 3D heat map may be a hologram or other projection in the microwave cavity.

A "stationary" visualization, map, waveform, or distribution may refer to a function of energy estimated to be experienced by a stationary object in a microwave (e.g., the cumulative energy density of the multiple resonant modes, $\Sigma_i U_i$). A "rotational" or "concentric" visualization, map, waveform, or distribution may refer to a function of energy estimated to be experienced by an object under rotational motion of a microwave tray in a microwave (e.g., the cumulative energy density of the multiple resonant modes integrated under full rotations, $\Sigma_i \int_0^{2\pi} U_i d\theta$).

The rotating tray may have imprinted on the surface thereof the rotational, i.e., concentric, visualization of the heat map. Other surfaces of the microwave cavity may also have imprinted thereon the rotational heat distribution. For example, the bottom surface underneath and/or radially peripheral to the rotating tray and/or the top surface may also have imprinted concentric rings. The side and back/front surfaces may have imprinted a pattern of the concentric rings intersecting the vertical planes of the respective surfaces. Alternatively, the heat distribution on one or more surfaces may be a stationary visualization (i.e., not under rotation) of a cross-section, aggregation, or projection of the 3D heat distribution lattice or array of nodes (cold-spots) and antinodes (hotspots) at the respective surfaces.

A map of color, pattern, contour, texture, shading, hue, opacity, field lines, arrows, symbols, dots, and/or other visual indicators, may be used to show the relative or absolute energy, temperature or heat values, for example, moving radially outward from the center of the microwave in concentric circles or arranged as a 3D lattice. A color map may use a color scale, e.g. from red to blue (or violet) indicating relatively more to less heat. A pattern map may use an increased density or range of symbols such as dots, arrows or other patterns to represent different heat values. Field lines may radiate, e.g., from cold to hot locations with increased density to indicate relatively more heat and decreased density to indicate relatively less heat. In some embodiments, the visualization may only show the heat map at positions that have threshold ranges of heat or energy (e.g., only visualizing hot-spots or rings). In some embodiments, the rotating tray may mark or illuminate one or more ideal positions or rings to place an object for even heating.

The visualization may act as a map for a user to identify an optimal or preferred position in the microwave to place an object (e.g., at what radius on the rotating tray) to achieve optimal or improved heating (e.g., increasing uniformity of heating throughout the object). For example, a container of food generally cooks faster near the container edge (having less insulation) than near the center of the container (having greater insulation). To increase uniform heating, a user may place a container so that it is centered along a ring with peak heat (e.g., a red ring) to compensate for this insulating effect. Centering the food container on a hot-spot may maximize the heat applied to well insulated areas and minimize the heat applied to poorly insulated areas, thereby balancing the overall heat distribution across the food container for more even cooking. The visualized concentric rings outline a path that the container will traverse when rotated by the tray. After the container traverses the ring's path of maximal heat, a user may choose to rotate the container 90 degrees (e.g., midway during heating) so that the container edges farthest from the maximal heat ring path (coldest spots) also traverse the maximal heat path to further even heating.

In some embodiments, where autonomous microwaves automatically determine the heating time, the visualization may act as a time map, in which cold-spots represent locations where the object will be heated for a relatively shorter duration and hot-spots represent locations where the object will be heated for a relatively longer duration. The visualization may guide a user to place the object at a position in the microwave (e.g., at a particular radius on the rotating tray) associated with a desired relative heating time. In some embodiments, instead of each radial ring representing a relative heating disparity that naturally occurs in the microwave, each ring may represent a different absolute time for heating. In one example, a series of concentric rings radiating outward from the center-line of the tray, or a pattern of zones on the tray, may each be colored or otherwise marked to indicate a continuous or discrete sequence of different times (e.g., rings incremented in 10, 20, 30 second or minute intervals). A user may thus place an object on the tray at a location associated with the desired time for heating (without explicitly entering any time).

In some embodiments, the microwave pattern may be a fixed visualization that may be etched, imprinted, painted, illuminated with LEDs or holograms, or affixed or projected in the microwave interior. In other embodiments, the microwave pattern may be imprinted on a removable microwave-safe insert or disk, e.g., that may be placed on the microwave tray. The fixed visualization may display the rotational heat map of concentric rings, e.g., computed as an average or aggregate of the heat distribution over a predetermined period of time (e.g., an integer multiple of the time of a complete tray rotation, such as, several second or minutes). In other embodiments, the microwave pattern may be a dynamic visualization that changes over time. The dynamic visualization may display either the stationary (non-rotating) heat map (e.g., oscillating nodes and antinodes) or the rotational heat map of concentric rings (e.g., each ring increasing in heat over time). The dynamic visualization may be displayed on a color-changing material, screen, illuminated with LEDs or holograms, or any other dynamic display on the interior or exterior surface of the microwave. Additionally or alternatively, the microwave pattern may be visualized on a separate device, remote from the microwave, such as on a user computer or smart phone. In one embodiment, the dynamic visualization may be implemented on a heat-reactive surface of the microwave altering the color pattern based upon the actual heat distribution in the microwave interior measured in real-time. In some embodiments, the dynamical visualization may differ when heating objects of different dimensions or specific heats (e.g., the amount of heat per unit mass required to raise the temperature of an object by one degree Celsius). In some embodiments, the dynamical visualization may be a real-time sensed or a pre-defined pre-recorded visualization stream of the oscillations of the standing waveforms in the microwave cavity, for example, visualizing the rise and fall of peaks and crests at nodes and relative stasis of the waveform at anti-nodes, or the shifting of nodes over time. In some embodiments, the visualizations and time settings may or may not take into account the effect that the object being heated has on the heat or energy distribution. For example, the fixed and/or dynamic visualizations may be computed assuming there is no object in the microwave, computed based on measurements of an object placed in the microwave (e.g., user-entered or detected by imagers or sensors), or computed for an example object such as an average size object in the microwave. In some embodiments, the fixed and/or dynamic visualization may activate and deactivate when the door opens/closes (or closes/opens) or the device is turned on/off (or off/on), respectively.

The precise pattern of the microwave heat distribution and/or time settings depends on various physical parameters of the individual microwave, such as, the dimensions of the microwave cavity, the electromagnetic field produced by the microwave, the specific heat or absorption rate and structure of the object being heated, etc.

Microwave energy distributions or waveforms may be computed in three dimensions, for example, as follows.

$$E_x=E_{x0}\cos k_x x\cdot\sin k_y y\cdot\sin k_z z\cdot e^{jwt}$$

$$E_y=E_{y0}\sin k_x x\cdot\cos k_y y\cdot\sin k_z z\cdot e^{jwt}$$

$$E_z=E_{z0}\sin k_x x\cdot\sin k_y y\cdot\cos k_z z\cdot e^{jwt} \quad (1)$$

where $E_{x0}$, $E_{y0}$ and $E_{z0}$ are energy amplitudes; $k_x=2\pi/\lambda_x$, $k_y=2\pi/\lambda_y$ and $k_z=2\pi/\lambda_z$ are the wavenumbers associated with respective wavelengths $\lambda_x$, $\lambda_y$, and $\lambda_z$ such that $$k_x=\frac{\pi n_x}{a_x},\ k_y=\frac{\pi n_y}{a_y}\ \text{and}\ k_z=\frac{\pi n_z}{a_z};$$

$n_x$, $n_y$ and $n_z$ are the resonant mode numbers; and $a_x$, $a_y$ and $a_z$ are the dimensions of the microwave cavity in three respective dimensions x, y and z; and w denotes resonant frequencies such that $$w=\pi c^2\sqrt{\frac{n_x^2}{a_x^2}+\frac{n_y^2}{a_y^2}+\frac{n_z^2}{a_z^2}}.$$

Microwave energy density may be computed, for example, as $U=\frac{1}{2}\varepsilon_0\vec{E}^2$, expressed in three dimensions as:

$$U_x=\frac{\varepsilon_0}{2}E_x^2 \quad (2)$$

-continued $$U_y = \frac{\varepsilon_0}{2} E_y^2$$

$$U_z = \frac{\varepsilon_0}{2} E_z^2$$

where $E_x$, $E_y$ and $E_z$ are defined, e.g., in equation (1), and $\varepsilon_0$ is, e.g., $8.854 \cdot 10^{-12}$.

The wavenumber may be expressed in three dimensions as:

$$\vec{k}^2 = k_x^2 + k_y^2 + k_z^2 \tag{3}$$

Substituting $$k_i = \frac{\pi n_i}{a_i} \text{ and } k_i = \frac{2\pi}{\lambda_i}$$

into equation (3) gives:

$$\frac{1}{\lambda^2} = \frac{n_x^2}{4a_x^2} + \frac{n_y^2}{4a_y^2} + \frac{n_z^2}{4a_z^2} \tag{4}$$

The resonant mode numbers are thus constrained to combinations of values that satisfies wavelengths $\lambda$ in the microwave range and the dimensions of the microwave cavity $a_x$, $a_y$ and $a_z$. Acceptable wavelengths $\lambda$ range between 12-12.5 cm in typical microwaves. To determine the associated resonant mode numbers that yield these wavelengths, equation (4) may be plotted, setting $n_x$, $n_y$ and $n_z$ to be three independent variables. The resonant mode numbers may be defined by the combinations of $n_7$, $n_y$ and $n_z$ in which the right-side of equation (4)

$$\frac{n_x^2}{4a_x^2} + \frac{n_y^2}{4a_y^2} + \frac{n_z^2}{4a_z^2}$$

falls within the range $$\left[\frac{1}{12^2}, \frac{1}{12.5^2}\right]$$

for the acceptable wavelength range [12 cm,12.5 cm] on the left-side of equation (4).

For the purpose of illustration only, example microwave dimensions of $a_x$=29 centimeters (cm), $a_y$=29 cm, $a_z$=19 cm are used, although any other dimensions may also be used. In this example, equation (4) may be solved by finding all combinations of resonant mode numbers $n_x$, $n_y$ and $n_z$ in which $$\frac{n_x^2}{4 \cdot 29^2} + \frac{n_y^2}{4 \cdot 29^2} + \frac{n_z^2}{4 \cdot 19^2}$$

tails within the range $$\left[\frac{1}{12^2}, \frac{1}{12.5^2}\right].$$

The following table lists all resonant modes that satisfy this requirement:

TABLE 1

List of Resonant Modes for Example Microwave

| Mode | $n_x$ | $n_y$ | $n_z$ |
|---|---|---|---|
| 1 | 0 | 1 | 3 |
| 2 | 1 | 1 | 3 |
| 3 | 2 | 3 | 2 |
| 4 | 2 | 4 | 1 |
| 5 | 3 | 2 | 2 |
| 6 | 4 | 2 | 1 |

The cumulative energy density may be computed as a sum average, superposition or any aggregation of solutions to equation (2) for all mode combinations that satisfy equation (4). The six modes that satisfy equation (4) in the example above are computed and displayed in FIGS. 2-7.

Reference is made to FIGS. 2-7, which are visualizations of horizontal 2D cross-sections of stationary 3D energy density distributions for the six respective resonant modes experienced by a stationary object in an example microwave, in accordance with some embodiments of the invention. FIGS. 2-14 illustrate a horizontal cross-section at an example height of z=8 cm in the microwave (e.g., a typical height of an object being heated), although any other height, projection, vertical average or accumulation, or cross-section may be displayed. The energy density distributions of FIGS. 2-14 are generated using the example microwave dimensions discussed above, however any other dimensions may be used in equation (4) to obtain associated mode numbers, which may be applied in equation (2) to generate energy densities for each mode.

The mode 1 stationary energy density distribution of FIG. 2 may be calculated, for example, as follows:

Mode 1: $n_x$=0, $n_y$=1, $n_z$=3. In mode 1, $k_x$=0, so the $E_y$ and $E_z$ terms in equation (1) include a factor of sin(0), reducing their values to zero. Equation (1) thereby has only one non-zero term $E_x$ in mode 1 and may be rewritten as:

$$E_{x,1} = E_{x0} \sin\frac{\pi}{a_y} y \cdot \sin\frac{3\pi}{a_z} z \cdot e^{jwt} \tag{5}$$

$$E_{y,1} = 0$$

$$E_{z,1} = 0$$

The stationary energy density in equation (2) for mode 1 is therefore:

$$U_1 = \frac{\varepsilon_0}{2} E_x^2 = \frac{\varepsilon_0}{2} E_{x0}^2 \cdot \sin^2\frac{\pi}{a_y} y \cdot \sin^2\frac{3\pi}{a_z} z \tag{6}$$

Figure 1:
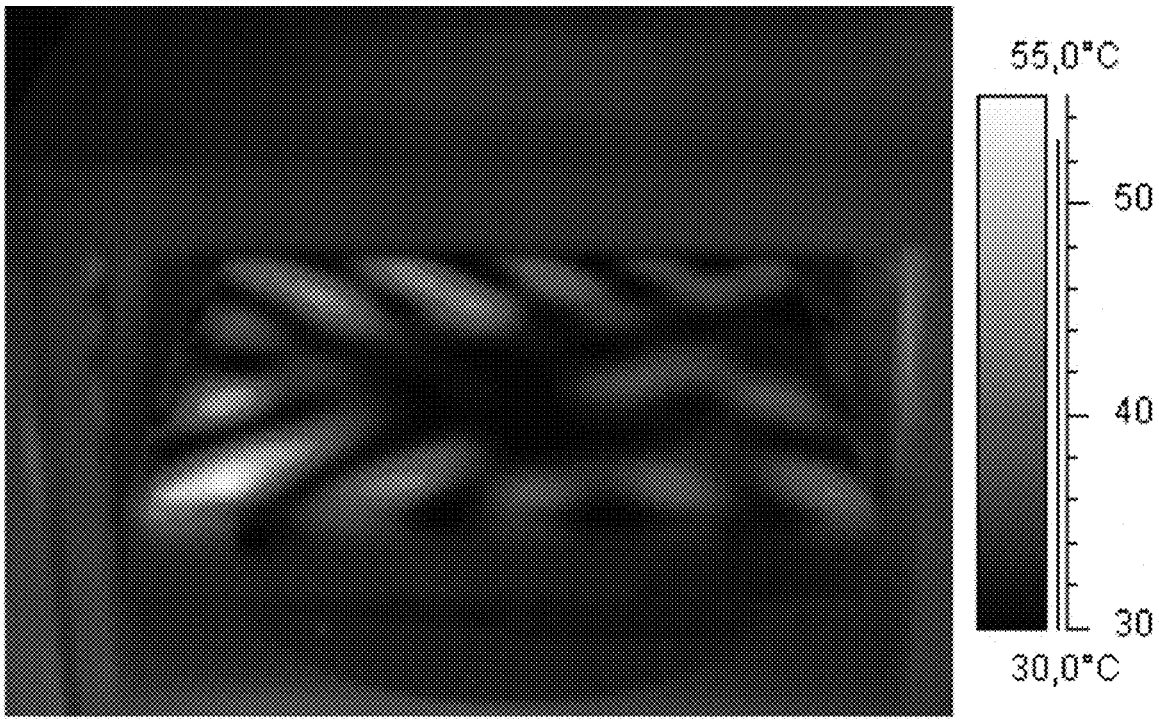
FIG. 1 is an infrared thermal image of a 2D glass plate coated with a thin film of water being heated by a microwave.
Figure 2:
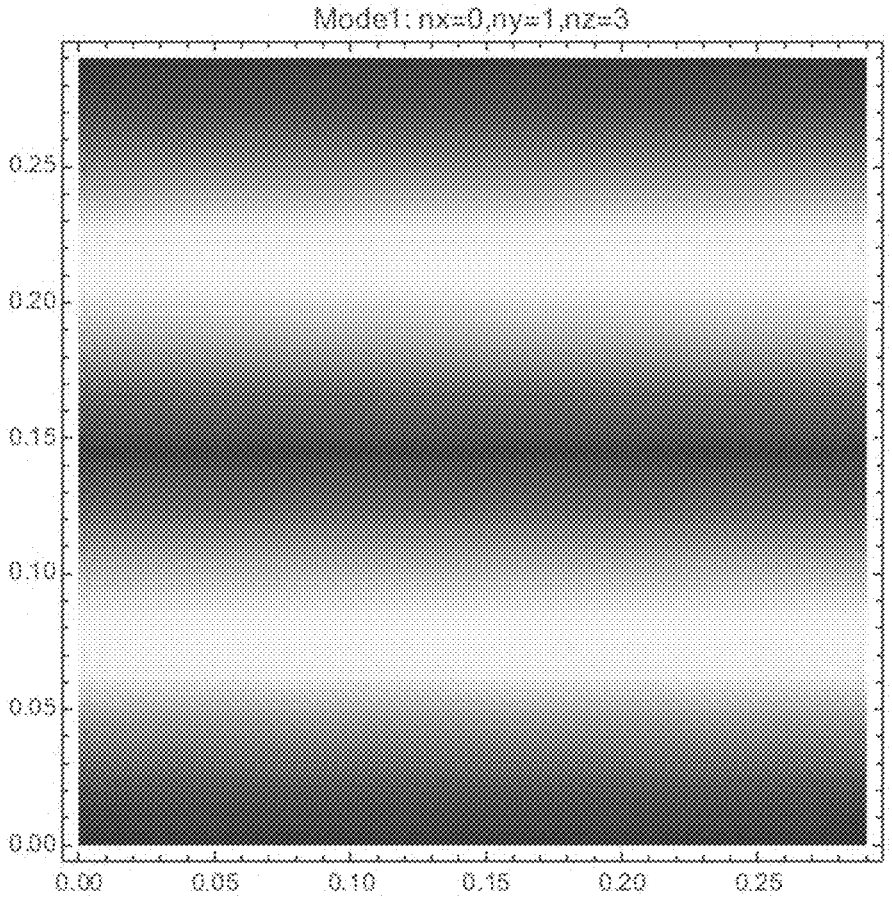
FIGS. 2-7 are visualizations of horizontal cross-sections of stationary energy density distributions for the six respective resonant modes experienced by a stationary object in an example microwave in accordance with some embodiments of the invention.

Because the stationary energy density in mode 1 equation (6) is independent of the (x) dimension, the visualization of FIG. 2 is ideally constant for all values of (x) at each depth (y) and height (z) (forming a striped pattern constant across the x-dimension in FIG. 2).

Figure 3:
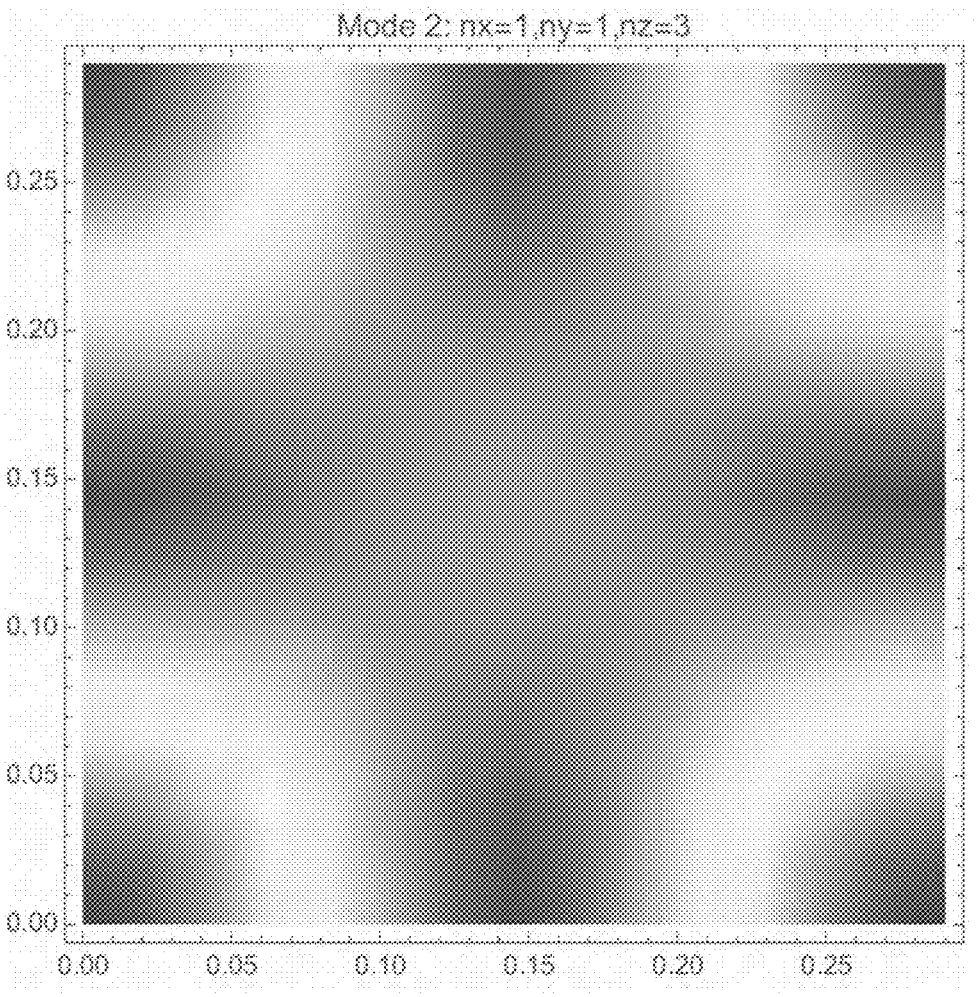

The mode 2 stationary energy density distribution of FIG. 3 may be calculated, for example, as follows:

Mode 2: $n_x=1$, $n_y=1$, $n_z=3$. In mode 2, $$k_x = \frac{\pi}{a_x},\ k_y = \frac{\pi}{a_y},\ \text{and}\ k_z = \frac{3\pi}{a_z}.$$

Equation (1) in mode 2 may be rewritten as:

$$\begin{aligned} E_{x,2} &= E_{x0}\cos\frac{\pi}{a_x}x\cdot\sin\frac{\pi}{a_y}y\cdot\sin\frac{3\pi}{a_z}z\cdot e^{jwt} \\ E_{y,2} &= E_{y0}\sin\frac{\pi}{a_x}x\cdot\cos\frac{\pi}{a_y}y\cdot\sin\frac{3\pi}{a_z}z\cdot e^{jwt} \\ E_{z,2} &= E_{z0}\sin\frac{\pi}{a_x}x\cdot\sin\frac{\pi}{a_y}y\cdot\cos\frac{3\pi}{a_z}z\cdot e^{jwt} \end{aligned} \tag{7}$$

The stationary energy density in equation (2) for mode 2 is therefore:

$$\begin{aligned} U_2 = \frac{\varepsilon_0}{2}(E_x^2+E_y^2+E_z^2) = \\ \frac{\varepsilon_0}{2}\Big(E_{x0}^2\cos^2\frac{\pi}{a_x}x\cdot\sin^2\frac{\pi}{a_y}y\cdot\sin^2\frac{3\pi}{a_z}z + E_{y0}^2\sin^2\frac{\pi}{a_x}x\cdot \\ \cos^2\frac{\pi}{a_y}y\cdot\sin^2\frac{3\pi}{a_z}z + E_{z0}^2\sin^2\frac{\pi}{a_x}x\cdot\sin^2\frac{\pi}{a_y}y\cdot\cos^2\frac{3\pi}{a_z}z\Big) \end{aligned} \tag{8}$$

Figure 4:
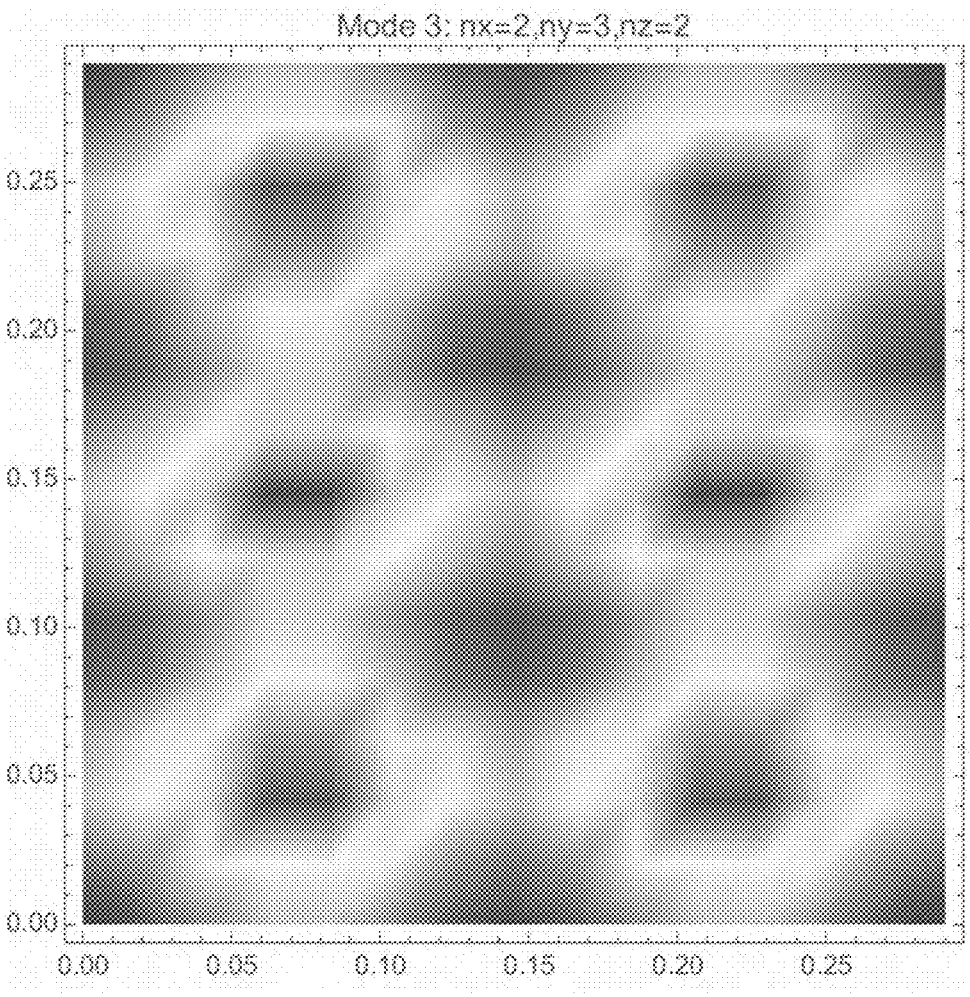

The mode 3 stationary energy density distribution of FIG. 4 may be calculated, for example, as follows:

Mode 3: $n_x=2$, $n_y=3$, $n_z=2$. In mode 3, $$k_x = \frac{2\pi}{a_x},\ k_y = \frac{3\pi}{a_y},\ \text{and}\ k_z = \frac{2\pi}{a_z}.$$

Equation (1) in mode 3 may be rewritten as:

$$\begin{aligned} E_{x,3} &= E_{x0}\cos\frac{2\pi}{a_x}x\cdot\sin\frac{3\pi}{a_y}y\cdot\sin\frac{2\pi}{a_z}z\cdot e^{jwt} \\ E_{y,3} &= E_{y0}\sin\frac{2\pi}{a_x}x\cdot\cos\frac{3\pi}{a_y}y\cdot\sin\frac{2\pi}{a_z}z\cdot e^{jwt} \\ E_{z,3} &= E_{z0}\sin\frac{2\pi}{a_x}x\cdot\sin\frac{3\pi}{a_y}y\cdot\cos\frac{2\pi}{a_z}z\cdot e^{jwt} \end{aligned} \tag{9}$$

The stationary energy density in equation (2) for mode 3 is therefore:

$$\begin{aligned} U_3 = \frac{\varepsilon_0}{2}(E_x^2+E_y^2+E_z^2) = \\ \frac{\varepsilon_0}{2}\Big(E_{x0}^2\cos^2\frac{2\pi}{a_x}x\cdot\sin^2\frac{3\pi}{a_y}y\cdot\sin^2\frac{2\pi}{a_z}z + E_{y0}^2\sin^2\frac{2\pi}{a_x}x\cdot \\ \cos^2\frac{3\pi}{a_y}y\cdot\sin^2\frac{2\pi}{a_z}z + E_{z0}^2\sin^2\frac{2\pi}{a_x}x\cdot\sin^2\frac{3\pi}{a_y}y\cdot\cos^2\frac{2\pi}{a_z}z\Big) \end{aligned} \tag{10}$$

Figure 5:
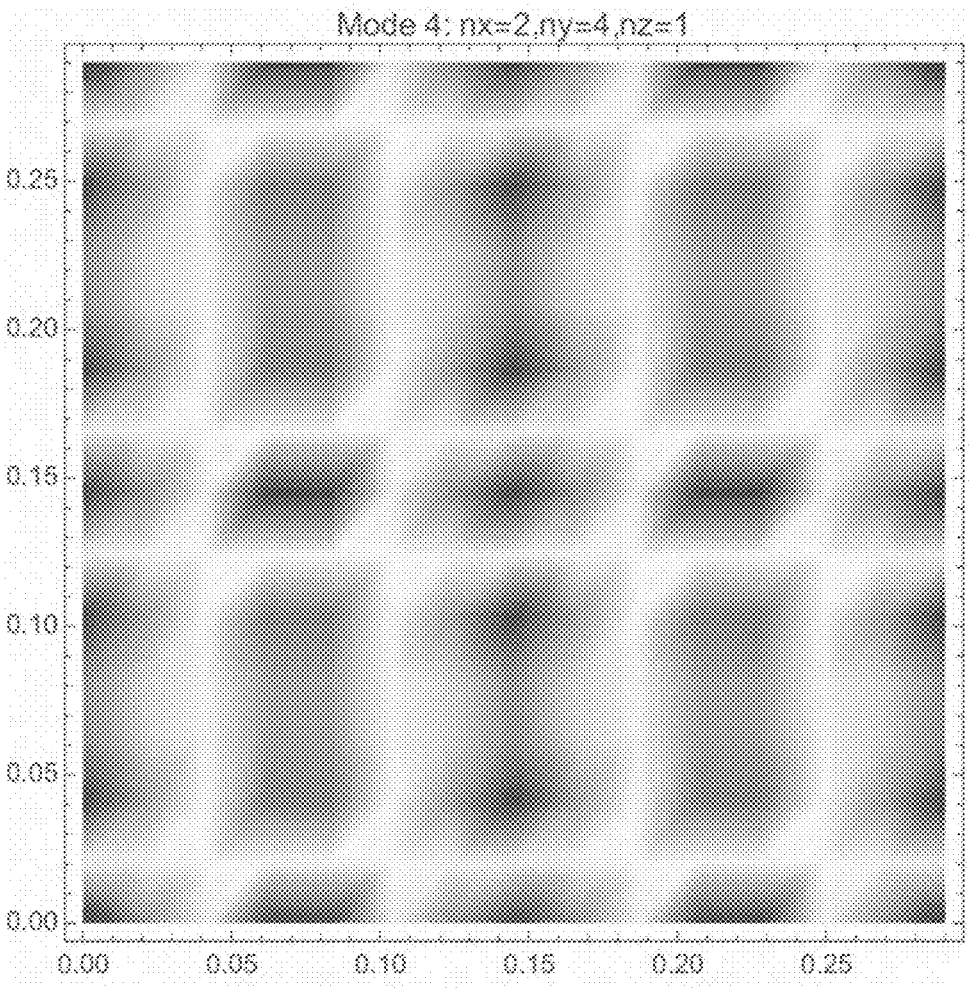

The mode 4 stationary energy density distribution of FIG. 5 may be calculated, for example, as follows:

Mode 4: $n_x=2$, $n_y=4$, $n_z=1$. In mode 3, $$k_x = \frac{2\pi}{a_x},\ k_y = \frac{4\pi}{a_y},\ \text{and}\ k_z = \frac{\pi}{a_z}.$$

Equation (1) in mode 4 may be rewritten as:

$$\begin{aligned} E_{x,4} &= E_{x0}\cos\frac{2\pi}{a_x}x\cdot\sin\frac{4\pi}{a_y}y\cdot\sin\frac{\pi}{a_z}z\cdot e^{jwt} \\ E_{y,4} &= E_{y0}\sin\frac{2\pi}{a_x}x\cdot\cos\frac{4\pi}{a_y}y\cdot\sin\frac{\pi}{a_z}z\cdot e^{jwt} \\ E_{z,4} &= E_{z0}\sin\frac{2\pi}{a_x}x\cdot\sin\frac{4\pi}{a_y}y\cdot\cos\frac{\pi}{a_z}z\cdot e^{jwt} \end{aligned} \tag{11}$$

The stationary energy density in equation (2) for mode 4 is therefore:

$$\begin{aligned} U_4 = \frac{\varepsilon_0}{2}(E_x^2+E_y^2+E_z^2) = \\ \frac{\varepsilon_0}{2}\Big(E_{x0}^2\cos^2\frac{2\pi}{a_x}x\cdot\sin^2\frac{4\pi}{a_y}y\cdot\sin^2\frac{\pi}{a_z}z + E_{y0}^2\sin^2\frac{2\pi}{a_x}x\cdot \\ \cos^2\frac{4\pi}{a_y}y\cdot\sin^2\frac{\pi}{a_z}z + E_{z0}^2\sin^2\frac{2\pi}{a_x}x\cdot\sin^2\frac{4\pi}{a_y}y\cdot\cos^2\frac{\pi}{a_z}z\Big) \end{aligned} \tag{12}$$

Figure 6:
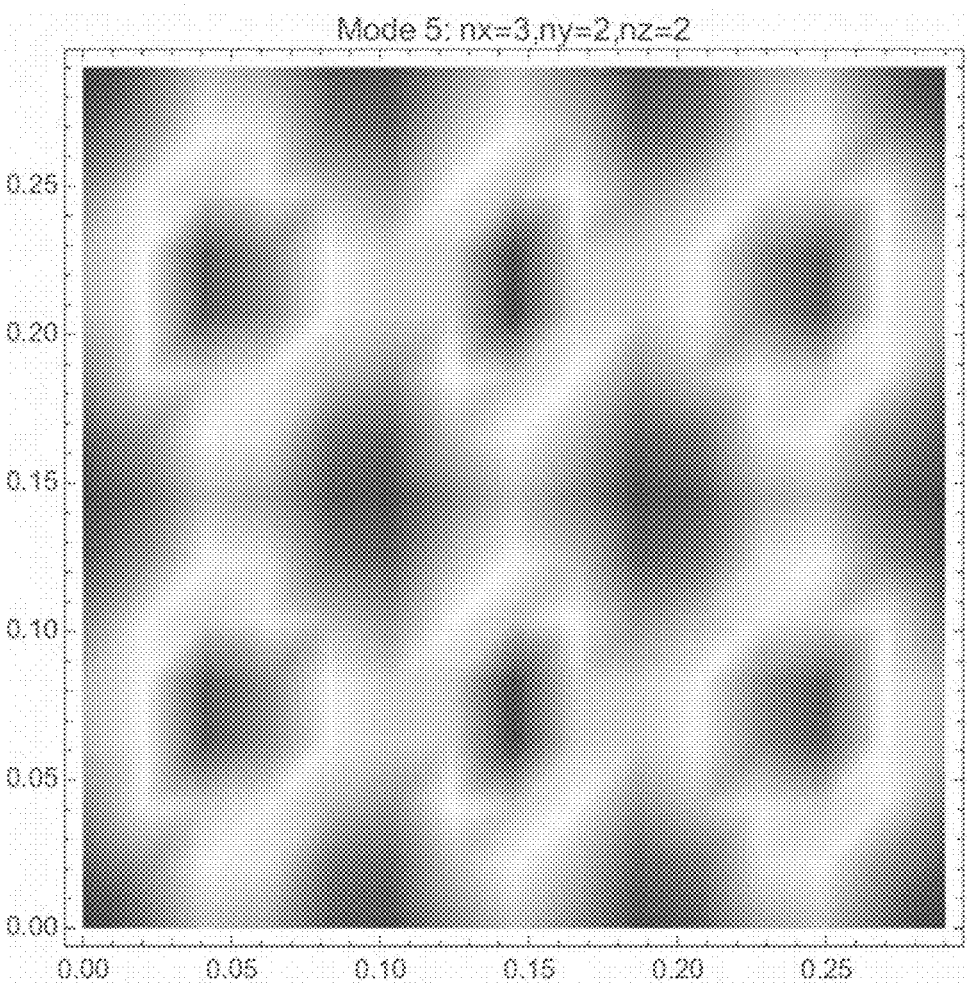

The mode 5 stationary energy density distribution of FIG. 6 may be calculated, for example, as follows:

Mode 5: $n_x=3$, $n_y=2$, $n_z=2$. In mode 5, $$k_x = \frac{3\pi}{a_x},\ k_y = \frac{2\pi}{a_y},\ \text{and}\ k_z = \frac{2\pi}{a_z}.$$

Equation (1) in mode 5 may be rewritten as:

$$\begin{aligned} E_{x,5} &= E_{x0}\cos\frac{3\pi}{a_x}x\cdot\sin\frac{2\pi}{a_y}y\cdot\sin\frac{2\pi}{a_z}z\cdot e^{jwt} \\ E_{y,5} &= E_{y0}\sin\frac{3\pi}{a_x}x\cdot\cos\frac{2\pi}{a_y}y\cdot\sin\frac{2\pi}{a_z}z\cdot e^{jwt} \\ E_{z,5} &= E_{z0}\sin\frac{3\pi}{a_x}x\cdot\sin\frac{2\pi}{a_y}y\cdot\cos\frac{2\pi}{a_z}z\cdot e^{jwt} \end{aligned} \tag{13}$$

The stationary energy density in equation (2) for mode 5 is therefore:

$$\begin{aligned} U_5 = \frac{\varepsilon_0}{2}(E_x^2+E_y^2+E_z^2) = \\ \frac{\varepsilon_0}{2}\Big(E_{x0}^2\cos^2\frac{3\pi}{a_x}x\cdot\sin^2\frac{2\pi}{a_y}y\cdot\sin^2\frac{2\pi}{a_z}z + E_{y0}^2\sin^2\frac{3\pi}{a_x}x\cdot \\ \cos^2\frac{2\pi}{a_y}y\cdot\sin^2\frac{2\pi}{a_z}z + E_{z0}^2\sin^2\frac{3\pi}{a_x}x\cdot\sin^2\frac{2\pi}{a_y}y\cdot\cos^2\frac{2\pi}{a_z}z\Big) \end{aligned} \tag{14}$$

Figure 7:
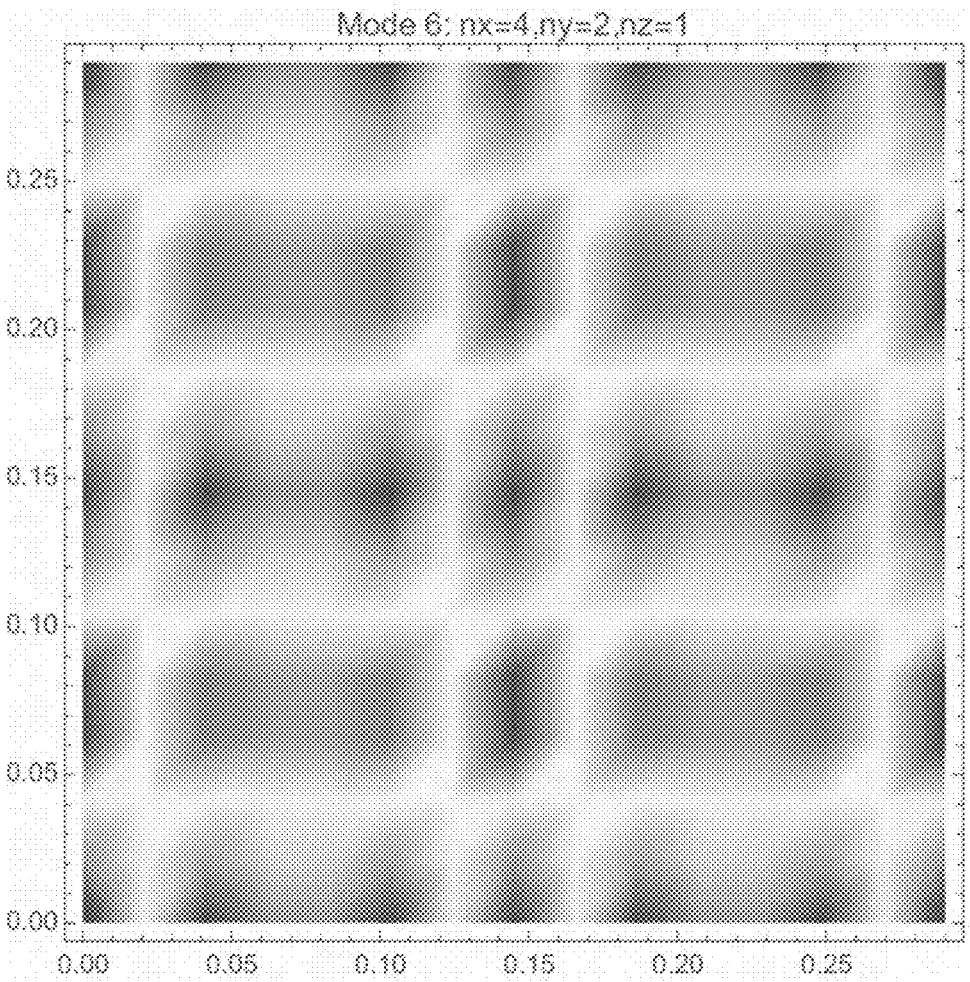

The stationary mode 6 energy density distribution of FIG. 7 may be calculated, for example, as follows:

Mode 6: $n_x=4$, $n_y=2$, $n_z=1$. In mode 6, $$k_x = \frac{4\pi}{a_x},\ k_y = \frac{2\pi}{a_y},\ \text{and}\ k_z = \frac{\pi}{a_z}.$$

Equation (1) in mode 6 may be rewritten as:

$$E_{x,6} = E_{x0}\cos\frac{4\pi}{a_x}x\cdot\sin\frac{2\pi}{a_y}y\cdot\sin\frac{\pi}{a_z}z\cdot e^{jwt} \tag{15}$$

$$E_{y,6} = E_{y0}\sin\frac{4\pi}{a_x}x\cdot\cos\frac{2\pi}{a_y}y\cdot\sin\frac{\pi}{a_z}z\cdot e^{jwt}$$

$$E_{z,6} = E_{z0}\sin\frac{4\pi}{a_x}x\cdot\sin\frac{2\pi}{a_y}y\cdot\cos\frac{\pi}{a_z}z\cdot e^{jwt}$$

The stationary energy density in equation 2 or mode 6 is therefore:

$$U_6 = \frac{\varepsilon_0}{2}(E_x^2+E_y^2+E_z^2) = \frac{\varepsilon_0}{2}\left(E_{x0}^2\cos^2\frac{4\pi}{a_x}x\cdot\sin^2\frac{2\pi}{a_y}y\cdot\sin^2\frac{\pi}{a_z}z + E_{y0}^2\sin^2\frac{4\pi}{a_x}x\cdot\cos^2\frac{2\pi}{a_y}y\cdot\sin^2\frac{\pi}{a_z}z + E_{z0}^2\sin^2\frac{4\pi}{a_x}x\cdot\sin^2\frac{2\pi}{a_y}y\cdot\cos^2\frac{\pi}{a_z}z\right) \tag{16}$$

The aggregated stationary energy density U may be represented as a sum of individual mode stationary energy densities $U_i$, for example, as follows:

$$U=\Sigma_{i=1}^{p}U_i \tag{17}$$

where p is the number of resonant modes for the microwave (e.g., p=6 in the example above). The sum may be weighted or unweighted.

Figure 15:
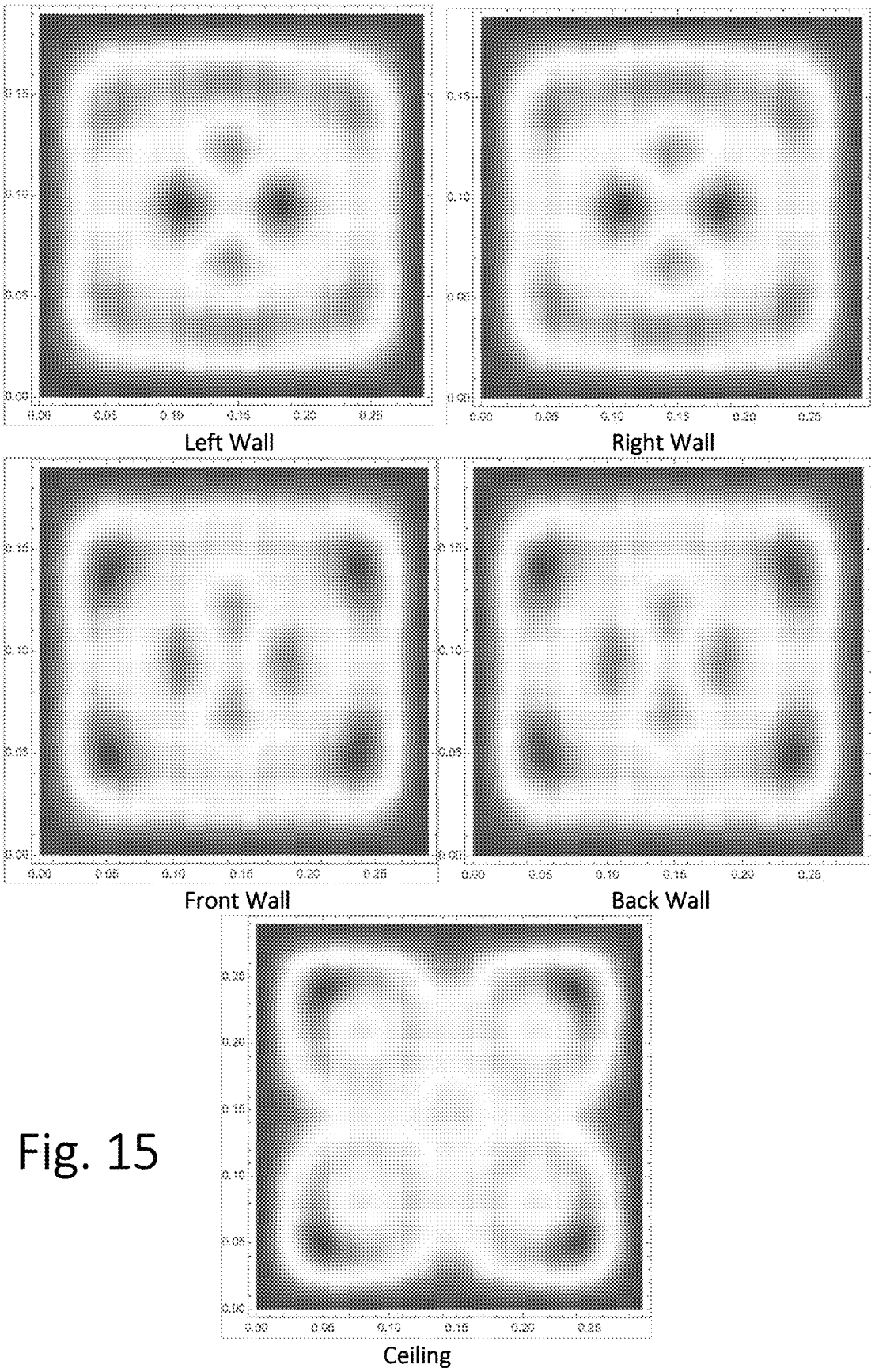
FIG. 15 shows visualizations of four side wall and a ceiling cross-sections of a cumulative stationary energy density distribution aggregating the distributions of FIGS. 2-7 for all modes experienced by a stationary object in an example microwave, in accordance with some embodiments of the invention.

The aggregated stationary energy density represented by equation (17) is the energy density combined from all resonant modes of the microwave, as experienced by a stationary object at each position in the microwave cavity. This aggregated stationary energy density may have a lattice-shaped pattern. FIG. 15 shows five cross-sections of the aggregated stationary energy density U along the four side walls and ceiling of the microwave cavity.

Microwave objects, however, are not typically stationary, but rotate in concentric circles under the force of a rotating tray. Accordingly, the lattice-shaped energy density (e.g., defined by equation (17)) may be rotated to form a concentric or rotational energy density that has a pattern of concentric circles that are radially symmetric about the z-axis center-line of the microwave. The concentric energy density may be fully rotationally symmetric, e.g., having infinite continuous rotational isometrics invariant under all rotations about the z-axis center-line from 0-2π radians, or any multiple thereof.

Reference is made to FIGS. 8-13, which are visualizations of horizontal 2D cross-sections of concentric 3D energy density distributions for the six respective resonant modes experienced under rotational motion of a microwave tray in an example microwave, in accordance with some embodiments of the invention. In some embodiments, the concentric energy density visualization may be continuously rotationally or radially symmetric about the (z) axis of rotation or center-line of the microwave tray. The concentric energy density visualizations may have a constant or single energy density along all points at each single radial distance from the axis of rotation, i.e., along each circle of points. At each radial distance from the center-line or axis of rotation, the visualization is a single ring representing the energy density experienced by an object rotating by one or more full rotations (or a fraction of a rotation) at that radial position. Thus, the 2D concentric energy distribution visualization shows a plurality of rings representing the concentric energy density experienced by an object when revolving on the tray an integer number (or fraction) of revolutions at each radius. Moving across the rings, e.g., from the tray's center point radially outward to the tray's edge, the concentric energy density oscillates (increasing and decreasing) continuously or discretely from ring to ring (e.g., depending on whether there is a continuous or discrete resolution of values).

To convert the stationary energy density shown in FIGS. 2-7 to the concentric energy density shown in FIGS. 8-13, the origin of the coordinate space may be translated from the edge of the microwave cavity to the center point of the tray's top surface, and the coordinate space may be converted from rectilinear (e.g., Cartesian) coordinates to angular (e.g., polar cylindrical, or spherical) coordinates to integrate over the rotational motion of a rotating tray. In one embodiment, the origin of the coordinate space may be translated to the tray center by translating coordinates (e.g., x,y,z) to $$\left(\text{e.g., } x-\frac{a_x}{2},\ y-\frac{a_y}{2},\ z\right).$$

In some embodiments, non-angular coordinates (e.g., x,y,z) may be converted (e.g., as x→r cos θ, y→r sin θ) to polar coordinates (e.g., r,θ,z or r,θ,Ø). Other conversions may also be used.

Mode 1: The mode 1 stationary energy density distribution of equation (6) may be expressed in polar coordinates, with an origin at the tray center, as:

$$U_{1_polar} = \frac{\varepsilon_0}{2}E_{x0}^2\cdot\sin^2\left(\frac{\pi}{a_y}\left(r\sin\theta-\frac{a_y}{2}\right)\right)\cdot\sin^2\frac{3\pi}{a_z}z \tag{18}$$

Figure 8:
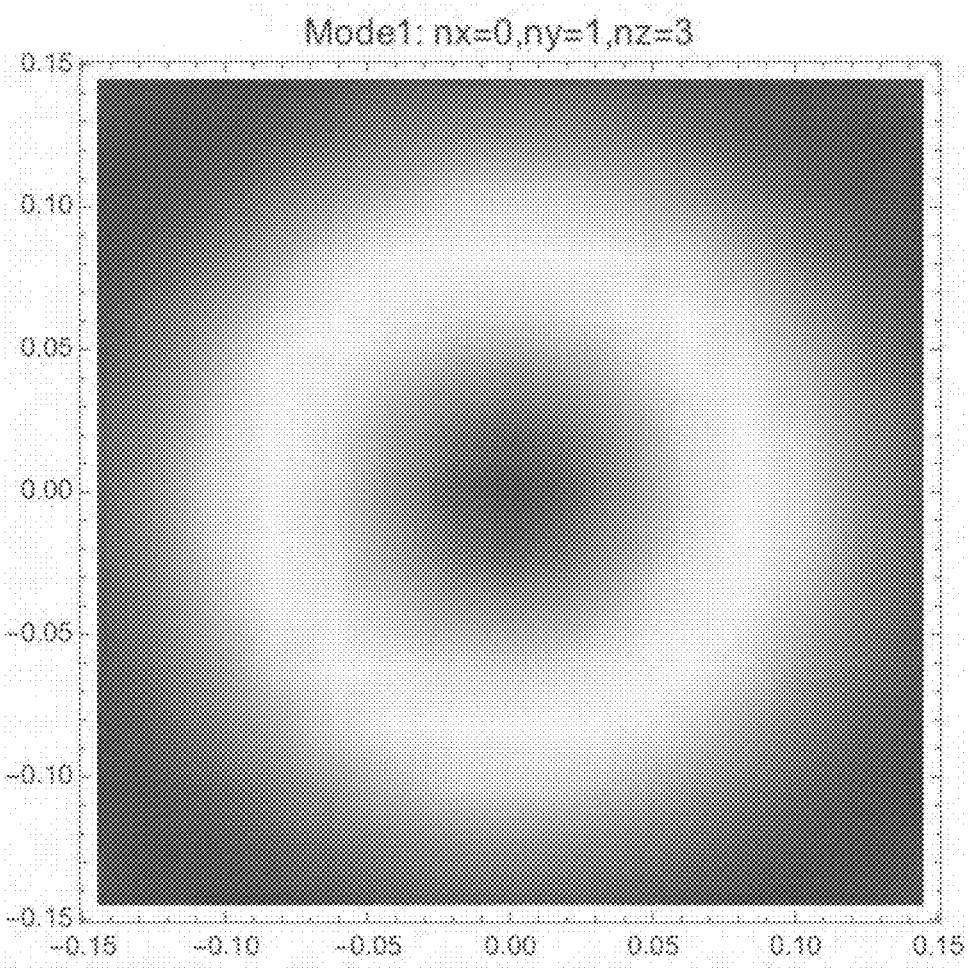
FIGS. 8-13 are visualizations of horizontal cross-sections of concentric energy density distributions for the six respective resonant modes experienced under rotational motion of a microwave tray in an example microwave, in accordance with some embodiments of the invention.

The stationary energy density may be aggregated, accumulated, averaged, or integrated, over all angles, e.g., θ from 0 to 2π radians, representing a complete revolution of the microwave tray, to form a concentric energy distribution, for example, as shown in FIG. 8. Alternatively or additionally, the energy density may be determined by a mixed number or fraction of (non-integer) revolutions, in which case the energy density may be aggregated over the subset of angles of the tray revolution, e.g., θ from 0 to <2π radians, representing the final incomplete revolution of the microwave tray. To determine the concentric energy density experienced under tray rotation, $CU_i$, the stationary energy density may be integrated with respect to rotational motion about the z-axis center-line of the microwave, θ, for example, for a full rotation from 0 to 2 π radii (or a multiple or fraction thereof). The concentric energy density in mode 1, $CU_1$, may be, for example:

$$CU_1 = \int_0^{2\pi} U_1 d\theta = \frac{\varepsilon_0}{2} E_{x0}^2 \cdot \sin^2 \frac{3\pi}{a_z} z \cdot \int_0^{2\pi} \sin^2\left(\frac{\pi}{a_y} r\sin\theta - \frac{\pi}{2}\right)\Big) \cdot d\theta \tag{19}$$

where $$\int_0^{2\pi} \sin^2\left(\frac{\pi}{a_y} r\sin\theta - \frac{\pi}{2}\right)\Big) \cdot d\theta = \frac{1}{2}\int_0^{2\pi}\left(1 - \cos\left(\frac{2\pi}{a_y} r\sin\theta - \pi\right)\right)\Big) \cdot d\theta$$

(since $$\sin^2(\alpha) = \frac{1}{2}(1 - \cos(2\alpha)), \text{ which is } \frac{1}{2}\int_0^{2\pi}\left(1 + \cos\left(\frac{2\pi}{a_y} r\sin\theta - \pi\right)\right)\Big) \cdot d\theta \text{ (since } \cos(\alpha - \pi) = -\cos(\alpha)),$$

which is $$\pi + \pi J_0\left(\frac{2\pi}{a_y}|r|\right)$$

(where $J_0$ the Bessel function of the first order, such that $$J_0(\alpha) = \frac{1}{2\pi}\int_0^{2\pi} \cos(\alpha\sin\theta)) \cdot d\theta).$$

Accordingly, the concentric energy density in mode 1 may be defined, for example, as follows:

$$CU_1 = \frac{\varepsilon_0}{2} E_{x0}^2 \cdot \sin^2 \frac{3\pi}{a_z} z \cdot \left\{\pi + \pi J_0\left(\frac{2\pi}{a_y}|r|\right)\right\} \tag{20}$$

FIG. 8 shows an example 2D horizontal cross-section of the concentric energy density of mode 1, $CU_1$.

Each mode's concentric energy density, $CU_i$, depends only on the radial distance (r) and height (r) dimensions, but is independent of the angular dimension (θ) defining rotation about the z-axis center-line. Thus, each horizontal cross-section in FIGS. 8-13 (e.g., having a constant z-dimension value) may be constant for all values of $\theta \in [0,2\pi]$ at each radial distance (r), thereby forming a pattern of concentric circles or rings at each radial distance (r) from the center z-line.

Mode 2: The mode 2 stationary energy density distribution of equation (8) may be expressed in polar coordinates, with an origin at the tray center point, as:

$$U_{2_polar} = \frac{\varepsilon_0}{2}\left(E_{x0}^2 \cos^2\left(\frac{\pi}{a_x} r\cos\theta - \frac{\pi}{2}\right) \cdot \sin^2\left(\frac{\pi}{a_y} r\sin\theta - \frac{\pi}{2}\right) \cdot \sin^2 \frac{3\pi}{a_z} z + E_{y0}^2 \sin^2\left(\frac{\pi}{a_x} r\cos\theta - \frac{\pi}{2}\right) \cdot \cos^2\left(\frac{\pi}{a_y} r\sin\theta - \frac{\pi}{2}\right) \cdot \sin^2 \frac{3\pi}{a_z} z + E_{z0}^2 \sin^2\left(\frac{\pi}{a_x} r\cos\theta - \frac{\pi}{2}\right) \cdot \sin^2\left(\frac{\pi}{a_y} r\sin\theta - \frac{\pi}{2}\right) \cdot \cos^2 \frac{3\pi}{a_z} z\right) \tag{21}$$

The concentric energy density experienced under tray rotation in mode 2, $CU_2$, may be generated by integrating the energy density, $U_{2_polar}$, with respect to rotational motion about the z-axis center-line of the microwave, θ, for example, by a full rotation from 0 to 2 π radii (or a multiple or fraction thereof), which in mode 2, may be, for example:

$$CU_2 = \int_0^{2\pi} U_2 d\theta = \frac{\varepsilon_0}{2}\left\{E_{x0}^2 \cdot \sin^2 \frac{3\pi}{a_z} z \cdot \int_0^{2\pi} \cos^2\left(\frac{\pi}{a_x} r\cos\theta - \frac{\pi}{2}\right) \cdot \sin^2\left(\frac{\pi}{a_y} r\sin\theta - \frac{\pi}{2}\right) d\theta + E_{y0}^2 \cdot \sin^2 \frac{3\pi}{a_z} z \int_0^{2\pi} \sin^2\left(\frac{\pi}{a_x} r\cos\theta - \frac{\pi}{2}\right) \cdot \cos^2\left(\frac{\pi}{a_y} r\sin\theta - \frac{\pi}{2}\right) d\theta + E_{z0}^2 \cdot \cos^2 \frac{3\pi}{a_z} z \int_0^{2\pi} \sin^2\left(\frac{\pi}{a_x} r\cos\theta - \frac{\pi}{2}\right) \cdot \sin^2\left(\frac{\pi}{a_y} r\sin\theta - \frac{\pi}{2}\right) d\theta\right\} \tag{22}$$

Figure 9:
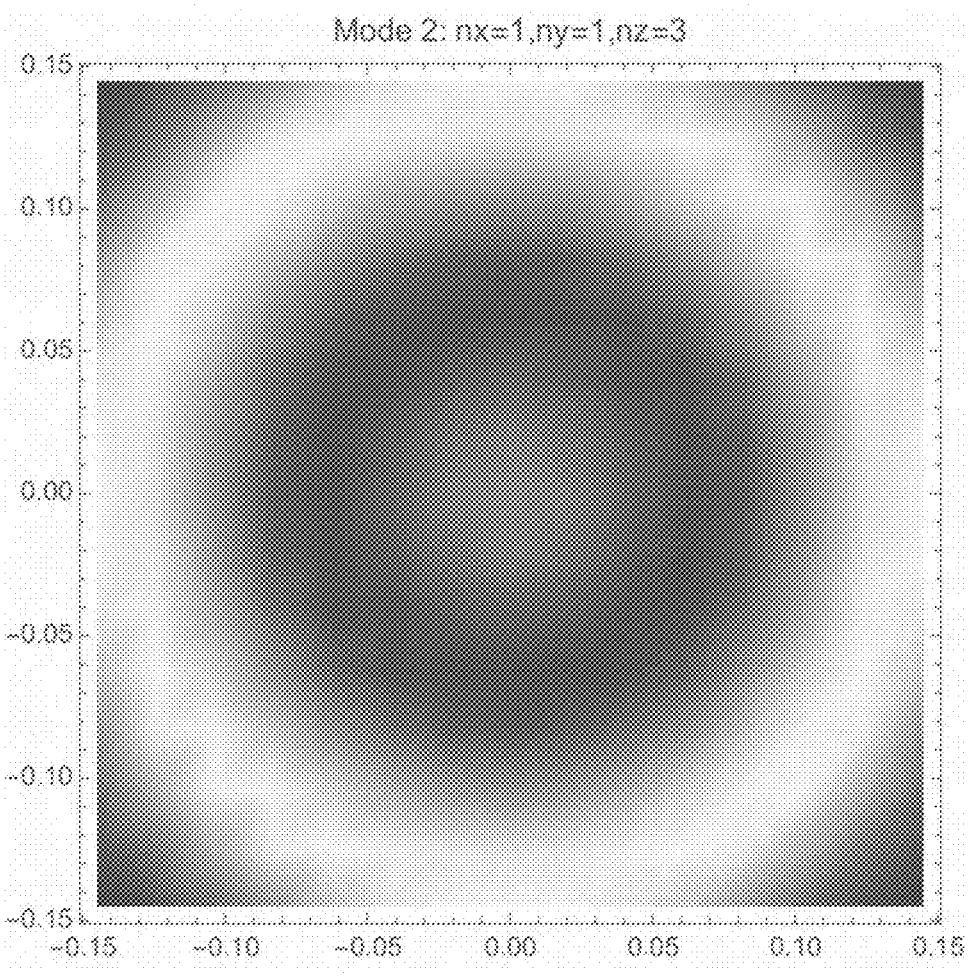

FIG. 9 shows an example 2D horizontal cross-section of the concentric energy density of mode 2, $CU_2$.

Mode 3: The mode 3 stationary energy density distribution of equation (10) may be expressed in polar coordinates, with an origin at the tray center, as:

$$U_{3_polar} = \frac{\varepsilon_0}{2}\left(E_{x0}^2 \cos^2\left(\frac{2\pi}{a_x} r\cos\theta - \pi\right) \cdot \sin^2\left(\frac{3\pi}{a_y} r\sin\theta - \frac{3\pi}{2}\right) \cdot \sin^2 \frac{2\pi}{a_z} z + E_{y0}^2 \sin^2\left(\frac{2\pi}{a_x} r\cos\theta - \pi\right) \cdot \cos^2\left(\frac{3\pi}{a_y} r\sin\theta - \frac{3\pi}{2}\right) \cdot \sin^2 \frac{2\pi}{a_z} z + E_{z0}^2 \sin^2\left(\frac{2\pi}{a_x} r\cos\theta - \pi\right) \cdot \sin^2\left(\frac{3\pi}{a_y} r\sin\theta - \frac{3\pi}{2}\right) \cdot \cos^2 \frac{2\pi}{a_z} z\right) \tag{23}$$

The concentric energy density experienced under tray rotation in mode 3, $CU_3$, may be computed, for example, as:

$$CU_3 = \int_0^{2\pi} U_3 d\theta = \frac{\varepsilon_0}{2}\left\{E_{x0}^2 \cdot \sin^2 \frac{2\pi}{a_z} z \cdot \int_0^{2\pi} \cos^2\left(\frac{2\pi}{a_x} r\cos\theta - \pi\right) \cdot \sin^2\left(\frac{3\pi}{a_y} r\sin\theta - \frac{3\pi}{2}\right) d\theta + E_{y0}^2 \cdot \sin^2 \frac{2\pi}{a_z} z \int_0^{2\pi} \sin^2\left(\frac{2\pi}{a_x} r\cos\theta - \pi\right) \cdot \cos^2\left(\frac{3\pi}{a_y} r\sin\theta - \frac{3\pi}{2}\right) d\theta + E_{z0}^2 \cdot \cos^2 \frac{2\pi}{a_z} z \int_0^{2\pi} \sin^2\left(\frac{2\pi}{a_x} r\cos\theta - \pi\right) \cdot \sin^2\left(\frac{3\pi}{a_y} r\sin\theta - \frac{3\pi}{2}\right) d\theta\right\} \tag{24}$$

Figure 10:
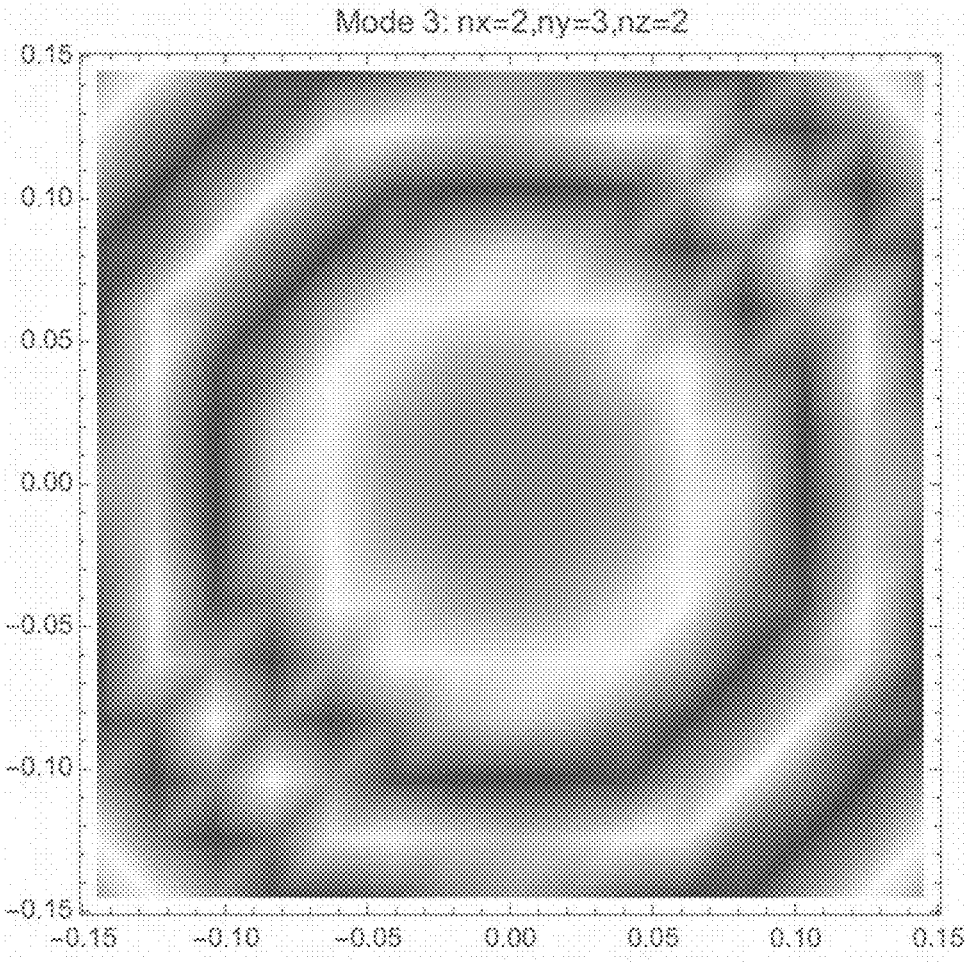

FIG. 10 shows an example 2D horizontal cross-section of the concentric energy density of mode 3, $CU_3$.

Mode 4: The mode 4 stationary energy density distribution of equation (12) may be expressed in polar coordinates, with an origin at the tray center, as:

$$U_{4_polar} = \frac{\varepsilon_0}{2}\left(E_{x0}^2 \cos^2\left(\frac{2\pi}{a_x} r\cos\theta - \pi\right) \cdot \sin^2\left(\frac{4\pi}{a_y} r\sin\theta - 2\pi\right) \cdot \sin^2 \frac{\pi}{a_z} z + E_{y0}^2 \sin^2\left(\frac{2\pi}{a_x} r\cos\theta - \pi\right) \cdot \cos^2\left(\frac{4\pi}{a_y} r\sin\theta - 2\pi\right) \cdot \sin^2 \frac{\pi}{a_z} z + E_{z0}^2 \sin^2\left(\frac{2\pi}{a_x} r\cos\theta - \pi\right) \cdot \sin^2\left(\frac{4\pi}{a_y} r\sin\theta - 2\pi\right) \cdot \cos^2 \frac{\pi}{a_z} z\right) \tag{25}$$

The concentric energy density experienced under tray rotation in mode 4, $CU_4$, may be computed, for example, as:

$$CU_4 = \int_0^{2\pi} U_4 d\theta = \frac{\varepsilon_0}{2}\left\{E_{x0}^2 \cdot \sin^2\frac{\pi}{a_z}z \int_0^{2\pi} \cos^2\left(\frac{2\pi}{a_x}r\cos\theta - \pi\right) \cdot \sin^2\left(\frac{4\pi}{a_y}r\sin\theta - 2\pi\right)d\theta + E_{y0}^2 \cdot \sin^2\frac{\pi}{a_z}z \int_0^{2\pi} \sin^2\left(\frac{2\pi}{a_x}r\cos\theta - \pi\right) \cdot \cos^2\left(\frac{4\pi}{a_y}r\sin\theta - 2\pi\right)d\theta + E_{z0}^2 \cdot \cos^2\frac{\pi}{a_z}z \int_0^{2\pi} \sin^2\left(\frac{2\pi}{a_x}r\cos\theta - \pi\right) \cdot \sin^2\left(\frac{4\pi}{a_y}r\sin\theta - 2\pi\right)d\theta\right\} \quad (26)$$

Figure 11:
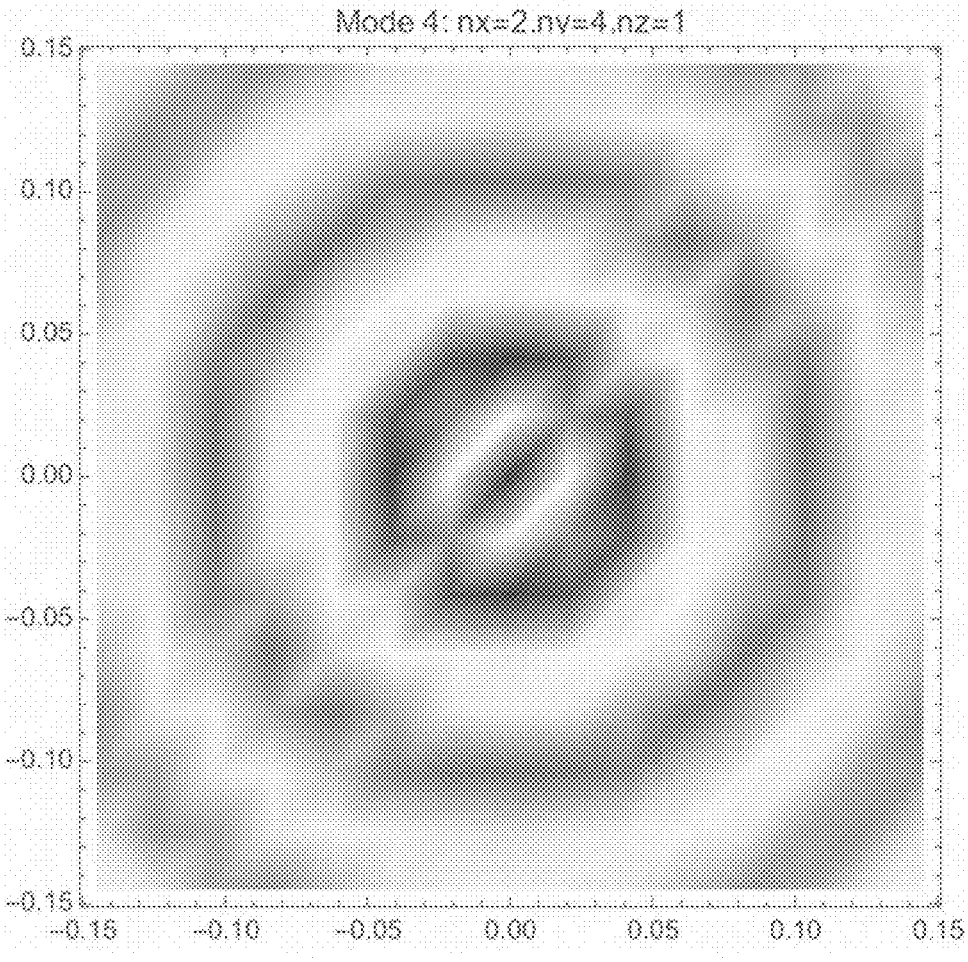

FIG. 11 shows an example 2D horizontal cross-section of the concentric energy density of mode 4, $CU_4$.

Mode 5: The mode 5 stationary energy density distribution of equation (14) may be expressed in polar coordinates, with an origin at the tray center, as:

$$U_{5_polar} = \frac{\varepsilon_0}{2}\left(E_{x0}^2\cos^2\left(\frac{3\pi}{a_x}r\cos\theta - \frac{3\pi}{2}\right) \cdot \sin^2\left(\frac{2\pi}{a_y}r\sin\theta - \pi\right) \cdot \sin^2\frac{2\pi}{a_z}z + E_{y0}^2\sin^2\left(\frac{3\pi}{a_x}r\cos\theta - \frac{3\pi}{2}\right) \cdot \cos^2\left(\frac{2\pi}{a_y}r\sin\theta - \pi\right) \cdot \sin^2\frac{2\pi}{a_z}z + E_{z0}^2\sin^2\left(\frac{3\pi}{a_x}r\cos\theta - \frac{3\pi}{2}\right) \cdot \sin^2\left(\frac{2\pi}{a_y}r\sin\theta - \pi\right) \cdot \cos^2\frac{2\pi}{a_z}z\right) \quad (27)$$

The concentric energy density experienced under tray rotation in mode 5, $CU_5$, may be computed, for example, as:

$$CU_5 = \int_0^{2\pi} U_5 d\theta = \frac{\varepsilon_0}{2}\left\{E_{x0}^2 \cdot \sin^2\frac{2\pi}{a_z}z \int_0^{2\pi} \cos^2\left(\frac{3\pi}{a_x}r\cos\theta - \frac{3\pi}{2}\right) \cdot \sin^2\left(\frac{2\pi}{a_y}r\sin\theta - \pi\right)d\theta + E_{y0}^2 \cdot \sin^2\frac{2\pi}{a_z}z \int_0^{2\pi} \sin^2\left(\frac{3\pi}{a_x}r\cos\theta - \frac{3\pi}{2}\right) \cdot \cos^2\left(\frac{2\pi}{a_y}r\sin\theta - \pi\right)d\theta + E_{z0}^2 \cdot \cos^2\frac{2\pi}{a_z}z \int_0^{2\pi} \sin^2\left(\frac{3\pi}{a_x}r\cos\theta - \frac{3\pi}{2}\right) \cdot \sin^2\left(\frac{2\pi}{a_y}r\sin\theta - \pi\right)d\theta\right\} \quad (28)$$

Figure 12:
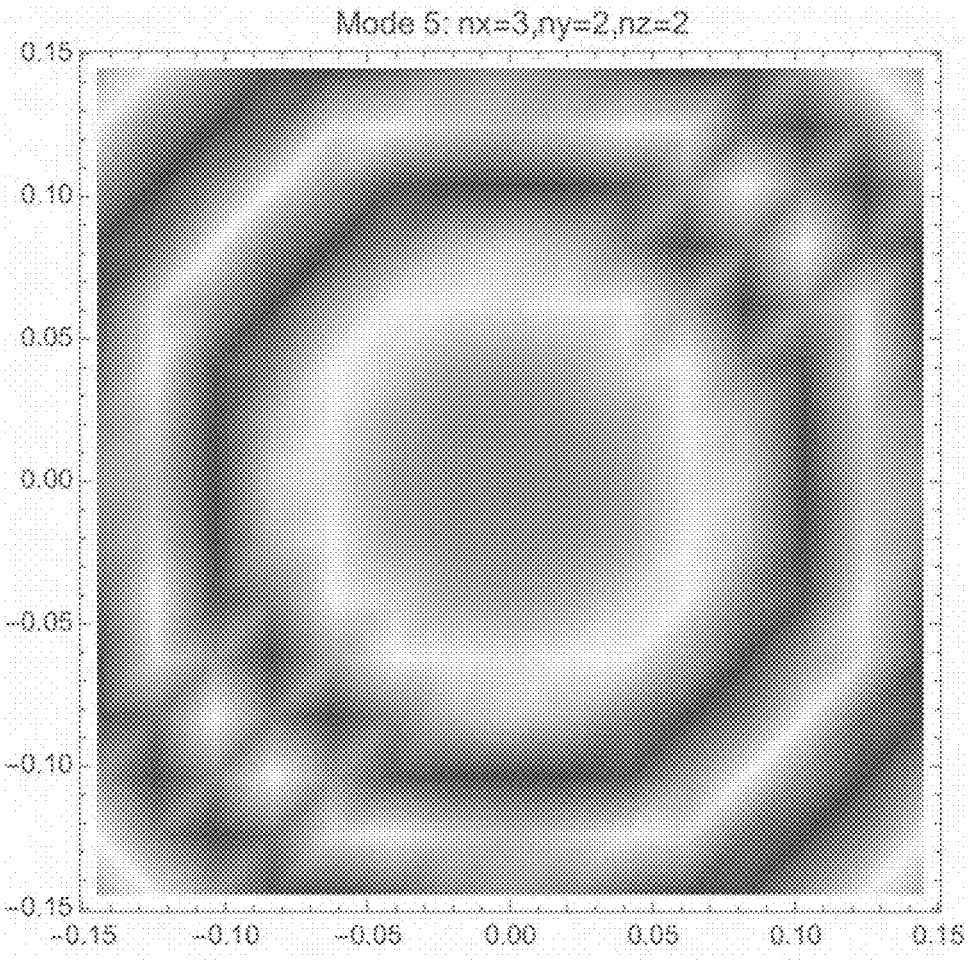

FIG. 12 shows an example 2D horizontal cross-section of the concentric energy density of mode 5, $CU_5$.

Mode 6: The mode 6 stationary energy density distribution of equation (16) may be expressed in polar coordinates, with an origin at the tray center, as:

$$U_{6_polar} = \frac{\varepsilon_0}{2}\left(E_{x0}^2\cos^2\left(\frac{4\pi}{a_x}r\cos\theta - 2\pi\right) \cdot \sin^2\left(\frac{2\pi}{a_y}r\sin\theta - \pi\right) \cdot \sin^2\frac{\pi}{a_z}z + E_{y0}^2\sin^2\left(\frac{4\pi}{a_x}r\cos\theta - 2\pi\right) \cdot \cos^2\left(\frac{2\pi}{a_y}r\sin\theta - \pi\right) \cdot \sin^2\frac{\pi}{a_z}z + E_{z0}^2\sin^2\left(\frac{4\pi}{a_x}r\cos\theta - 2\pi\right) \cdot \sin^2\left(\frac{2\pi}{a_y}r\sin\theta - \pi\right) \cdot \cos^2\frac{\pi}{a_z}z\right) \quad (29)$$

-continued

The concentric energy density experienced under tray rotation in mode 6, $CU_6$, may be computed, for example, as:

$$CU_6 = \int_0^{2\pi} U_6 d\theta = \frac{\varepsilon_0}{2}\left\{E_{x0}^2 \cdot \sin^2\frac{\pi}{a_z}z \int_0^{2\pi} \cos^2\left(\frac{4\pi}{a_x}r\cos\theta - 2\pi\right) \cdot \sin^2\left(\frac{2\pi}{a_y}r\sin\theta - \pi\right)d\theta + E_{y0}^2 \cdot \sin^2\frac{\pi}{a_z}z \int_0^{2\pi} \sin^2\left(\frac{4\pi}{a_x}r\cos\theta - 2\pi\right) \cdot \cos^2\left(\frac{2\pi}{a_y}r\sin\theta - \pi\right)d\theta + E_{z0}^2 \cdot \cos^2\frac{\pi}{a_z}z \int_0^{2\pi} \sin^2\left(\frac{4\pi}{a_x}r\cos\theta - 2\pi\right) \cdot \sin^2\left(\frac{2\pi}{a_y}r\sin\theta - \pi\right)d\theta\right\} \quad (30)$$

Figure 13:
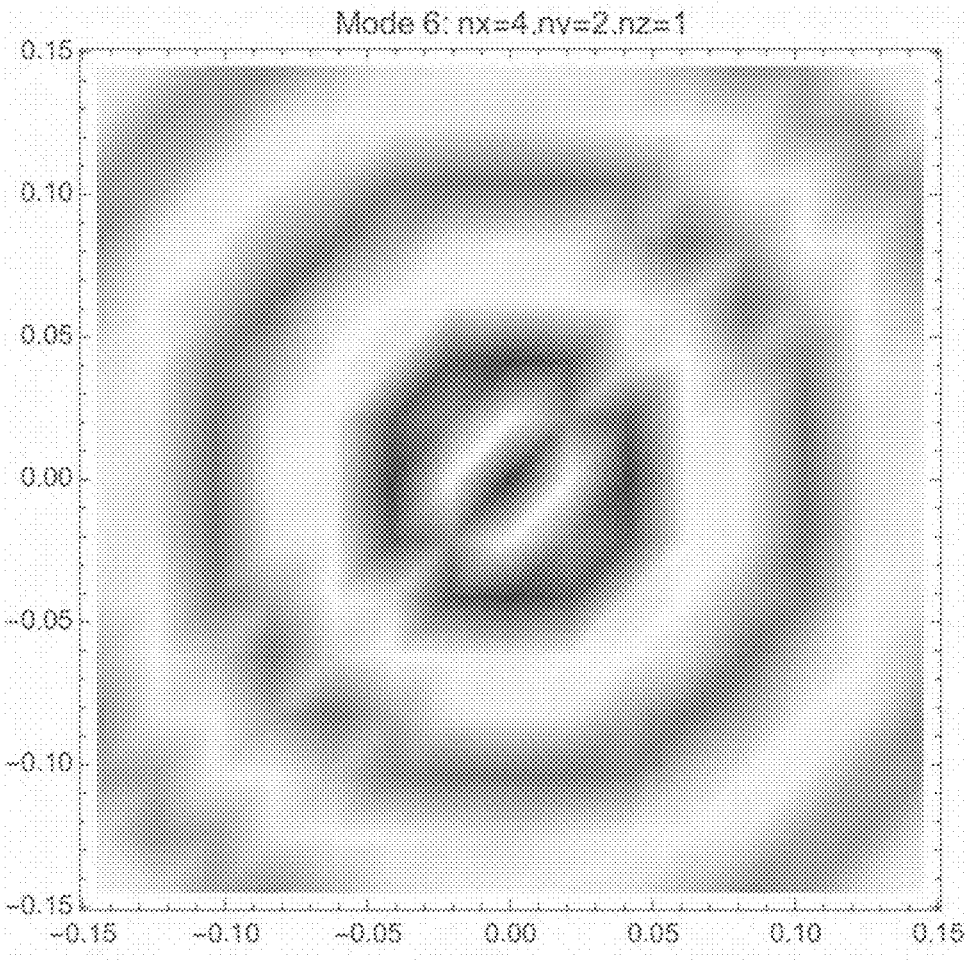

FIG. 13 shows an example 2D horizontal cross-section of the concentric energy density of mode 6, $CU_6$.

Figure 14:
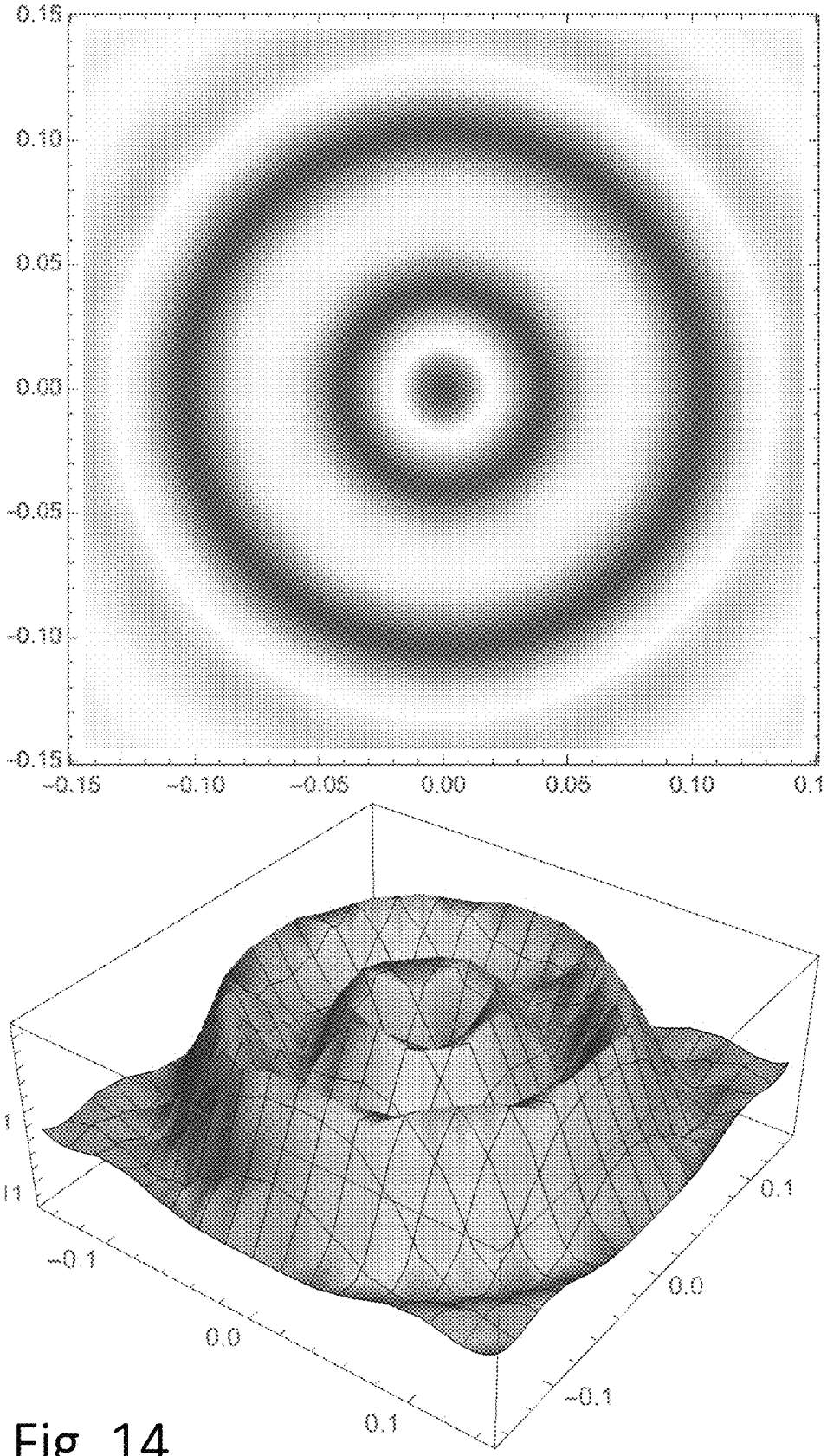
FIG. 14 is a visualization of a horizontal cross-section of a cumulative concentric energy density distribution aggregating the distributions of FIGS. 8-13 for all modes experienced under rotational motion of a microwave tray in an example microwave, in accordance with some embodiments of the invention.

Reference is made to FIG. 14, which is a visualization of a horizontal cross-section of a cumulative concentric energy density distribution aggregating the distributions of FIGS. 8-13 for all modes experienced under rotational motion of a microwave tray in an example microwave, in accordance with some embodiments of the invention. The visualization may be a color map (top image of FIG. 14), a contour map (bottom image of FIG. 14), or any other visualization of the cumulative concentric energy distribution. The cumulative concentric energy density CU may represent a sum, average, superposition or any aggregation of the individual mode concentric energy densities $CU_i$, for example, as follows:

$$CU = \Sigma_{i=1}^{p} CU_i \quad (31)$$

where p is the number of resonant modes for the microwave (e.g., p=6 in the example above).

Alternatively, instead of aggregating or integrating the energy density (e.g., equation (2)) over the angular rotation of a tray, e.g., in polar coordinates, some embodiments may aggregate or integrate an energy distribution (e.g., equation (1) or a derivation thereof) over time, e.g., for the duration of time it takes a microwave tray to complete a full rotation (e.g., 10-15 seconds).

Some embodiments of the invention may visualize a 2D representation of a heat or energy distribution on one or more inner surface(s) of a microwave cavity. In various embodiments, the various inner surfaces may depict 2D representations of only the concentric energy density, only the lattice-shaped stationary energy density, or a combination of a combination of the concentric energy density (e.g., on rotating tray surface and/or bottom/top inner surfaces) and the stationary energy density (e.g., on side and/or back/front inner surfaces).

Since the heat or energy distribution visualizations of FIGS. 2-14 are 2D representations of a 3D waveform pattern, the imprinted visualization on the microwave surfaces may be aggregates, averages, cross-sections, projections, or further integrations, of the 3D heat distribution. The 2D visualization may be printed on the surface of the microwave's revolving tray, the sidewalls, ceiling, floor, or any or all interior surface(s) of the microwave cavity.

Additionally or alternatively, the heat or energy distribution of the microwave's interior may be visualized on the microwave's exterior surface, for example, allowing the user to "see inside" the microwave.

In an ideal cavity resonator, the energy distribution approaches zero near the cavity walls. In some embodiments, to provide more useful information, the 2D heat distribution visualization on the inner surfaces may be projections, such as (a single or an average or integration of multiple) cross-section(s) of the 3D heat or energy distribution on parallel surfaces interior to those cavity wall surfaces. For example, the top surface, bottom surface and/or rotating tray may have imprinted a vertical (z) projection of one (or an integration of multiple) horizontal cross-section (s). A horizontal cross-section may depict the heat or energy distribution at a single height z, for example, at the top surface of the tray, an average height at which food is commonly placed, or any other desired height (e.g., z=8 cm as in FIGS. 2-14). A vertical integration may aggregate, accumulate, or average, the 3D heat or energy distribution along multiple (a subset or all) points of a normal vertical (z) axis for each point (x,y) on the 2D surface. Such a 2D visualization may represent the aggregated heat or energy experienced along an objects height, e.g., in the z-dimension. Values aggregated along the vertical axis may be un-weighted or weighted, e.g., weighing points according to probabilities that objects are placed at those positions. Weights may be distributed according to a square, Gaussian or other distribution along the z-axis, (e.g., assigning higher weights to points between zero and mid-height where objects are typically located and lower weights to points above mid-height to top where objects are less frequently located). The 2D heat distribution visualization may aggregate values of points over a vertical distance along a partial or full height of the microwave cavity, such as, from an upper surface of the microwave tray ($z_0$) (e.g., the bottom of an object being heated) to a height ($z_1$) (e.g., a top surface of the object). Height ($z_1$) may be a predicted, average or example, height of a typical object in the microwave (e.g., a half or third of the height of the microwave cavity). In another embodiment, height ($z_1$) may be an actual measured height of an object being microwaved, e.g., automatically detected by sensors in the microwave or manually entered by a user into a microwave user control panel or interface. The heat or energy distribution aggregated over a vertical distance ($z_0$ to $z_1$) may be computed, for example, by integrating equations $CU_i$ between $z_0$ and $z_1$ with respect to the vertical (z) dimension as follows:

$$\int_{z_0}^{z_1} CU_i dz. \tag{32}$$

Similarly, the right and/or left wall surfaces may have imprinted a horizontal projection (e.g., along the x-axis) of one (or an integration of multiple) vertical (y-z) cross-section(s) and the front and/or back surfaces may have imprinted a horizontal projection (e.g., along the y-axis) of one (or an integration of multiple) vertical (x-z) cross-section(s). Side surfaces may be computed according to embodiments disclosed with respect to the top and bottom surfaces (e.g., single or multiple cross-sections, integrations, weighted values, etc.), adjusted for their respective orientations.

In some cases, instead of aggregating heat values in the vertical dimension, some embodiments may generate the heat map based on a single horizontal cross-section defining the heat map for a single sample or representative vertical value. In another embodiment, the 2D simplification may be a 2D horizontal cross-section of the 3D heat distribution, for example, defining the heat map for a single representative vertical (z) height, such as, at the level of the upper surface of the rotating tray, the bottom of the interior microwave cavity (z=0), the mid-level of the microwave cavity (z=½ height of cavity), at a height where the object's center is most likely to reside (e.g., z=⅓ height of cavity), or any other predefined, automatically sensed, or manually entered, one or more vertical positions.

The above operations, e.g., of aggregating, projecting, and sampling, performed along the z-dimension may apply equally, under coordinate rotations, to the x and y dimensions.

In some embodiments, the vertical heat distribution may not be simplified, but may be fully visualized, along the cavity walls, e.g., as shown in FIG. 15. A user operating the microwave may use the vertical heat distribution visualization, e.g., imprinted along the interior side-walls of the microwave, to determine at what height or vertical position to place an object. In some embodiments, the rotating tray may have an adjustable height, e.g., so that a user may adjust the tray height to center an object at a vertical position in line with a desired heat node or anti-node. Adjusting the height of the rotating tray will change the heat experience along the tray at its new height. In some embodiments, the heat map imprinted on the tray may change dynamically when the tray height changes to visualize the heat experienced at the new position.

Reference is made to FIG. 15, which shows visualizations of four microwave side wall cross-sections and a microwave ceiling cross-section of a cumulative stationary energy density distribution aggregating the distributions of FIGS. 2-7 for all modes experienced by a stationary object in an example microwave, in accordance with some embodiments of the invention. The "Left Wall" visualization may be imprinted on the left interior side wall of the microwave cavity and is a vertical cross-section of the aggregated stationary energy density along the y-z plane at x=0. The "Right Wall" visualization may be imprinted on the right interior side wall of the microwave cavity and is a vertical cross-section of the aggregated stationary energy density along the y-z plane at $x=a_x$. The "Front Wall" visualization may be imprinted on the front wall of the microwave cavity (on the inside surface of the microwave door) and is a vertical cross-section of the aggregated stationary energy density along the x-z plane at y=0. Typically, the front wall surface of a microwave is partially composed of a faraday cage, which may or may not have a pattern imprinted on the interior or exterior surface of the cage grating. The "Back Wall" visualization may be imprinted on the back wall of the microwave cavity (shown in FIG. 16) and is a vertical cross-section of the aggregated stationary energy density along the x-z plane at $y=a_y$. The "Ceiling" visualization may be imprinted on the top interior surface or ceiling of the microwave cavity and is a horizontal cross-section of the aggregated stationary energy density along the x-y plane at $z=a_z$.

Reference is made to FIG. 16, which schematically illustrates a visualization of a 3D energy distribution, imprinted on interior 2D surfaces of an example microwave oven 1, in accordance with some embodiments of the invention.

Microwave oven 1 has a casing 2 and a cavity 4 arranged in the casing. Microwave oven 1 may have a control panel 3 or, in some fully-automated embodiments, may not have a control panel. A rotating tray 5, on which objects are placed for heating, is positioned horizontally level near the base of the microwave cavity. Rotating tray 5 rotates clockwise and/or counter-clockwise about a vertical center-line (z), which is orthogonal to the surface of the rotating tray 5 at its center-point. The front side of the oven cavity is formed by a door 7, which includes a faraday cage providing partial visibility of the interior cavity 4 when the door is closed during heating. Microwave oven 1 includes a microwave source 8 for generating microwaves, e.g., with a frequency of 2.45 GHz, and a microwave guide 9 for projecting the microwaves through one or more openings 10 (e.g., typically arranged on a side wall 12) into cavity 4. Oven cavity 4 includes top and bottom surfaces 14, left and right side surfaces 12, and front and back surfaces 15.

Microwave 1 may have one or more processors 6 and memories 13. Processor 6 may perform operations and methods described according to embodiments of the invention. Memory 13 may store data and may comprise software or a computer-readable non-transitory storage medium, such as a nonvolatile memory or hard disk, storing a program or instructions therein, which when executed cause processor 6 to carry out operations and methods described according to embodiments of the invention.

Processor 6 may autonomously determine a duration of time for heating an object based on the object's location. Processor 6 may determine or obtain the location of the object in 3D (e.g., x,y,z coordinates), 2D (e.g., x,y or r,θ coordinates) or 1D (e.g., radial distance r from the center-point of the tray) in microwave cavity 4. Microwave 1 may have one or more imagers or other sensors to detect the location of the object. Alternatively or additionally, rotating tray 5 may include, or be connected to, a scale or detector, for example, to measure the object's weight (when the object is located at a centered position on tray 5 at an initialization phase) and torque (when the object is placed at its location for heating). Processor 6 may determine the radial location of the object based on its weight and torque. Alternatively or additionally, a user may enter or verify the object location, e.g., using control panel 3. Other systems may be used to determine object location.

Processor 6 may operate in partially-automated or fully-automated modes. In the partially-automated mode, microwave 1 may receive a target duration of time for heating the object (e.g., a user-entered time or setting selected on control panel 3). Processor 6 may determine an offset duration of time based on an increase or decrease in a function of cumulative energy experienced by the object at the location relative to a threshold. The offset duration of time may be negatively (or inversely) proportional to the function of cumulative energy, e.g., positive (or relatively larger) to increase heating time when the function defines negative or below threshold heating (at a cold-spot), and negative (or relatively smaller) to decrease heating time when the function defines positive or above threshold heating (at a hot-spot). Processor 6 may shift the target heating duration by the offset duration to cancel the relative increase or decrease in cumulative energy experienced by the object due to the object's position. In the fully-automated mode, processor 6 may determine the duration of time for heating an object as a function of a cumulative energy estimated to be experienced by the object based on the location of the object and/or other parameters such as, the object's weight, density, size, temperature, type, or state, such as, solid or liquid, etc. In either the partially or fully automated modes, processor 6 may compute, or retrieve from memory 13, the durations of time associated with the object's locations and/or other parameters. Memory 13 may store a predefined correspondence or transformation between one or more parameters (e.g., location or radial distance from the object center to the center point of tray 5) and offset time or total heating time. When the total heating time is based on multiple properties (e.g., location, weight, object type, etc.), memory 13 may store a correspondence or function mapping each combination or vector of property values to a total or offset heating time. Once the heating duration of time is determined, processor 6 may trigger microwave source 8 (in coordination with microwave guide 9) to heat the object for the determined duration of time.

Microwave 1 may have a visualization imprinted on an interior surface of cavity 4. The visualization may represent a function of cumulative energy or heat experienced under rotational motion of a rotating tray about a center-line thereof, wherein the visualization comprises a plurality of rings concentric about the z-axis center-line of the rotating tray. In the example of FIG. 16, rotating tray 5 surface is imprinted with a 2D cross-section of the cumulative concentric energy density distribution of the six modes, as shown in FIG. 14 (e.g., projected at a cross-sectional height of z=8 cm). The two interior side wall surfaces 12 of microwave oven 1 in FIG. 16 may be imprinted with the 2D (y-z axis) "Left Wall" and "Right Wall" cross-sections of FIG. 15 visualizing the sum of the stationary modes of FIGS. 2-7, e.g., with x=0 and $a_x$, respectively (or based on a different sampled x position or an integrated range of x values). The back and/or front interior surfaces 15 of microwave oven 1 in FIG. 16 may be imprinted with a 2D (x-z axis) "Front Wall" and "Back Wall" cross-section of FIG. 15 visualizing the sum of the stationary modes of FIGS. 2-7, e.g., with y=0 and $a_y$, respectively (or based on a different sampled y position or an integrated range of y values). The top interior surface 14 and/or a portion of the interior bottom surface (e.g., under or radially outward from the rotational disk) of microwave oven 1 in FIG. 16 may be imprinted with a 2D (x-y axis) "Ceiling" cross-section of FIG. 15 and a "Floor" cross-section (not shown) visualizing the sum of the stationary modes of FIGS. 2-7, e.g., with $z=a_z$ and 0, respectively (or based on a different sampled z position or an integrated range of z values). In another example, top and bottom surfaces may visualize the cumulative concentric energy density. In addition, the outer microwave surfaces may be imprinted with the visualization of the corresponding interior surface sharing a wall.

Additionally or alternatively to the above visualizations, microwave oven 1 may use the functions in these heat maps to autonomously determine or adjust the duration of time for heating an object, such that, an initial or target time is increased or decreased proportionally to the increase or decrease in the heat distribution at the object's location relative to a threshold or average heat or at an average location. In a fully-automated implementation, microwave oven 1 may fully determine the initial time and may not include control panel 3. In other embodiments, microwave oven 1 may include control panel 3 for non-automated use, or to provide information other than heating time, such as object weight or type). In a partially-automated implementation, microwave oven 1 may include control panel 3 to receive the initial time input by a user.

The particular heat or energy distributions, waveforms or maps illustrated in FIGS. 2-16 are computed based on specific example microwave dimensions (e.g., $a_x$=29 cm, $a_y$=29 cm, $a_z$=19 cm) and are meant only as examples. The visualizations in FIGS. 2-16 may be generalized, for example, according to the equations above e.g. (1)-(4), to visualize the waveforms of any other microwave having any other dimensions and modes. It may be appreciated by persons of ordinary skill in the art that any function of energy may be derived and visualized from the equations above, for example, including energy, energy density, heat, heat flux, temperature, work, power, or any combination and/or derivation thereof. These functions of energy may further be transformed, for example, by averaging, scaling, normalizing, applying thresholds, taking cross-sections, integrating, differentiation, translating, rotating, switching to different domains or coordinate systems such as spherical or cylindrical coordinate systems, or any other mathematical operation(s).

In some embodiments, instead of or in addition to computing the microwave heat distributions or waveforms, the microwave heat distributions or waveforms may be measured, for example, using an array of non-conductive temperature sensors heated by the microwave.

Embodiments of the invention include microwaves, visualization materials or patterns for microwaves, and methods of manufacturing or operating the microwaves disclosed herein.

When used herein, a position or location of an object may refer to a position of the object in 1D (e.g., a radial distance from the object's center of mass, geometric center, or edge to the center line of the rotating tray, in 2D (e.g., a planar area occupied by the object, or a range of distances from the object to the center line), or in 3D (e.g., a Cartesian (x,y,z) coordinate of the object's geometric or mass center, or a 3D region occupied by the object).

The invention claimed is:

1. A microwave oven comprising:

a visualization imprinted on an interior surface of a cavity of the microwave oven, wherein the visualization represents a function of cumulative energy experienced under rotational motion of a rotating tray in the microwave oven about a center-line of the rotating tray that is orthogonal to the top surface of the rotating tray at its center-point, wherein the visualization comprises a plurality of rings concentric about the center-line, each concentric ring visualizes a constant value of the function of cumulative energy, and the plurality of rings visualize a plurality of different values of the function of cumulative energy that oscillate along a line from the radial center to the radial edge of the rotating tray, wherein the function of cumulative energy is based on an aggregated energy density of multiple resonant modes of the microwave oven experienced under a cumulative angular rotation about the center-line of the rotating, and wherein the function of cumulative energy is a function of $\Sigma_i \int_0^{2\pi} U_i d\theta$, where i represents each of the multiple resonant modes of the microwave oven, $U_i$ represents the energy density of resonant mode i, and $\theta$ represents an angular rotation of the rotating tray about the center-line.

2. The microwave oven of claim 1, wherein the aggregated energy density of the resonant modes is computed in cartesian coordinates and the function of cumulative energy is computed in polar coordinates.

3. The microwave oven of claim 1, wherein the function of cumulative energy is computed along a horizontal cross-section in the microwave cavity.

4. The microwave oven of claim 1, wherein the function of cumulative energy is aggregated over a vertical range in the microwave cavity.

5. The microwave oven of claim 1 having a second visualization imprinted on a second interior surface of the cavity of the microwave oven, the second visualization representing a function of cumulative energy estimated to be experienced by a stationary object in the microwave cavity.

6. The microwave oven of claim 5, wherein the second visualization comprises a lattice of hot-spots or cold-spots.

* * * * *